US011239551B2

(12) United States Patent
Ramasamy et al.

(10) Patent No.: US 11,239,551 B2
(45) Date of Patent: Feb. 1, 2022

(54) SYSTEM AND METHOD FOR AN ANTENNA SYSTEM CO-LOCATED AT A SPEAKER GRILL

(71) Applicant: Dell Products, LP, Round Rock, TX (US)

(72) Inventors: Suresh K. Ramasamy, Cedar Park, TX (US); Changsoo Kim, Cedar Park, TX (US); Timothy C. Shaw, Austin, TX (US); Geroncio O. Tan, Austin, TX (US)

(73) Assignee: Dell Products, LP, Round Rock, TX (US)

( * ) Notice: Subject to any disclaimer, the term of this patent is extended or adjusted under 35 U.S.C. 154(b) by 72 days.

(21) Appl. No.: 16/741,495

(22) Filed: Jan. 13, 2020

(65) Prior Publication Data

US 2021/0218135 A1 Jul. 15, 2021

(51) Int. Cl.
*H01Q 1/44* (2006.01)
*H04R 1/02* (2006.01)
*H01Q 13/18* (2006.01)

(52) U.S. Cl.
CPC ..... *H01Q 1/44* (2013.01); *H01Q 13/18* (2013.01); *H04R 1/023* (2013.01)

(58) Field of Classification Search
CPC ..... H01Q 1/44; H01Q 3/18; H04R 1/023
See application file for complete search history.

(56) References Cited

U.S. PATENT DOCUMENTS

| | | | | |
|---|---|---|---|---|
| 10,862,190 | B1 * | 12/2020 | Ramasamy | H04R 1/025 |
| 10,938,113 | B1 * | 3/2021 | Kim | H04R 1/023 |
| 2009/0002248 | A1 * | 1/2009 | Zhao | H01Q 1/243 343/722 |
| 2010/0092022 | A1 * | 4/2010 | Hopkinson | H04R 1/023 381/391 |
| 2012/0194393 | A1 * | 8/2012 | Uttermann | H01Q 1/52 343/702 |
| 2014/0080553 | A1 * | 3/2014 | Torset | H04M 1/7246 455/575.8 |
| 2016/0327986 | A1 * | 11/2016 | Farahani | G06F 1/1662 |
| 2017/0170545 | A1 * | 6/2017 | Merli | H01Q 9/0421 |
| 2019/0220067 | A1 * | 7/2019 | Sugiura | H01Q 21/28 |
| 2020/0044316 | A1 * | 2/2020 | Ruaro | H01Q 5/335 |
| 2020/0117235 | A1 * | 4/2020 | McClure | H01Q 1/42 |

* cited by examiner

*Primary Examiner* — Lam T Mai
(74) *Attorney, Agent, or Firm* — Prol Intellectual Property Law, PLLC; H. Kenneth Prol

(57) ABSTRACT

An information handling system to wirelessly transmit and receive data may include a processor; a memory; an input/output (I/O) device; a wireless adapter; a metal C-cover to house a speaker grill, the speaker grill covering a speaker to emit audio waves; the speaker grill formed within the C-cover to emit a target radio frequency (RF), including: a slot formed around an operative antenna portion of the speaker grill forming a peninsula of the speaker grill in the C-cover; an antenna cavity formed on a back side of the peninsula, the antenna cavity including walls formed around the cavity in the back side of the peninsula; and a tuning module operatively coupled to the speaker grill to excite the speaker grill and dynamically switch frequencies based on the target frequency to be emitted by the speaker grill.

20 Claims, 12 Drawing Sheets

SYSTEM AND METHOD FOR AN ANTENNA SYSTEM CO-LOCATED AT A SPEAKER GRILL

FIELD OF THE DISCLOSURE

The present disclosure generally relates to information handling systems, and more particularly relates to an information handling system including an antenna system co-located at a speaker grill.

BACKGROUND

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

For purposes of this disclosure, an information handling system may include any instrumentality or aggregate of instrumentalities operable to compute, calculate, determine, classify, process, transmit, receive, retrieve, originate, switch, store, display, communicate, manifest, detect, record, reproduce, handle, or utilize any form of information, intelligence, or data for business, scientific, control, or other purposes. For example, an information handling system may be a personal computer (e.g., desktop or laptop), tablet computer, mobile device (e.g., personal digital assistant (PDA) or smart phone), server (e.g., blade server or rack server), a network storage device, or any other suitable device and may vary in size, shape, performance, functionality, and price. The information handling system may include random access memory (RAM), one or more processing resources such as a central processing unit (CPU) or hardware or software control logic, read-only memory (ROM), and/or other types of nonvolatile memory. Additional components of the information handling system may include one or more disk drives, one or more network ports for communicating with external devices as well as various input and output (I/O) devices, such as a keyboard, a mouse, touchscreen and/or a video display. The information handling system may also include one or more buses operable to transmit communications between the various hardware components. The information handling system may also include telecommunication, network communication, and video communication capabilities. The information handling system may also include one or more buses operable to transmit communications between the various hardware components. The information handling system may also include telecommunication, network communication, and video communication capabilities. Information handling system chassis parts may include case portions such as for a laptop information handling system including the C-cover over components designed with a metal structure. The information handling system may be configurable with one or more antenna systems located within the chassis.

BRIEF DESCRIPTION OF THE DRAWINGS

It will be appreciated that for simplicity and clarity of illustration, elements illustrated in the Figures are not necessarily drawn to scale. For example, the dimensions of some elements may be exaggerated relative to other elements. Embodiments incorporating teachings of the present disclosure are shown and described with respect to the drawings herein, in which.

The use of the same reference symbols in different drawings may indicate similar or identical items.

DETAILED DESCRIPTION OF THE DRAWINGS

Figure 1:
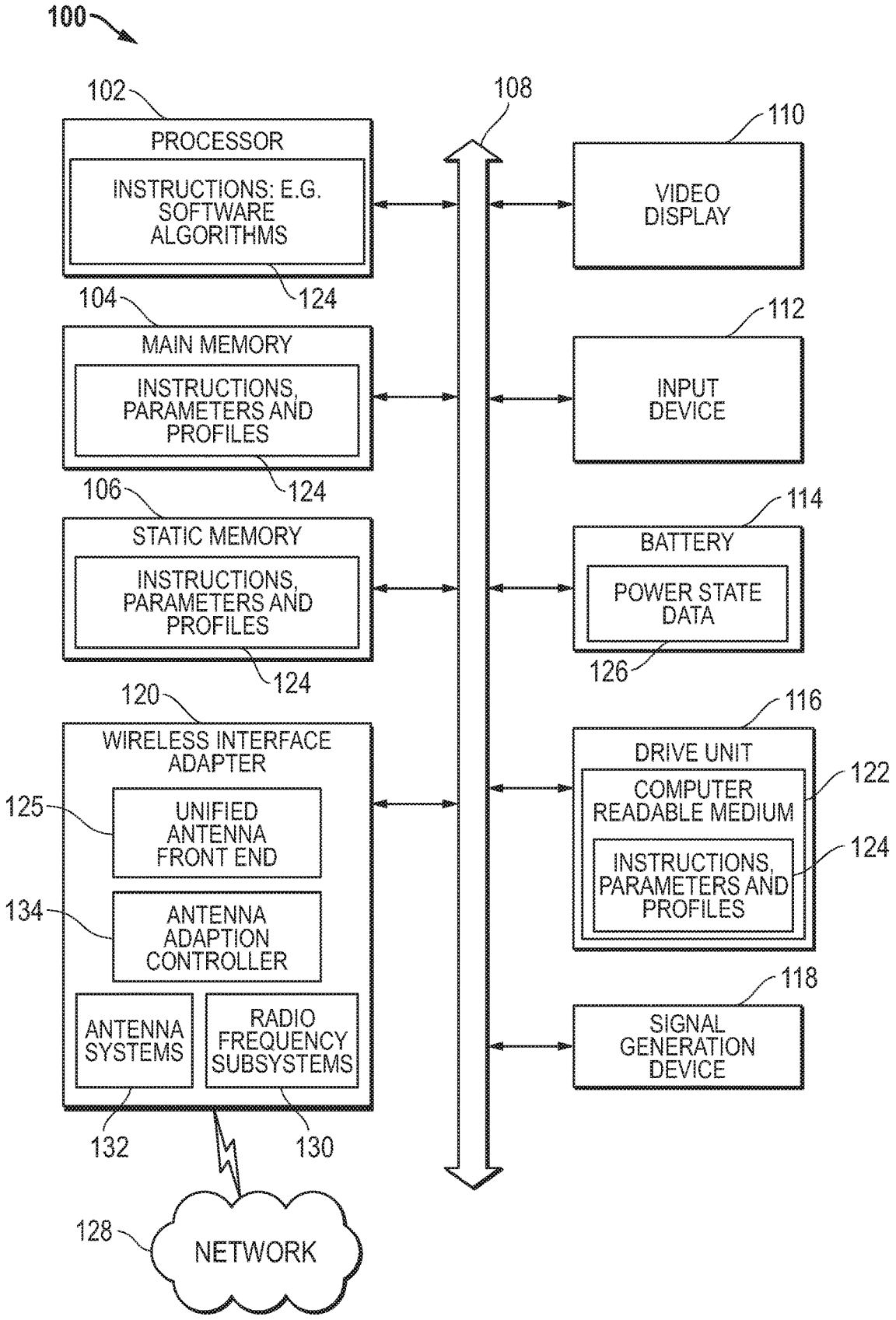
FIG. 1 illustrates an embodiment of information handling system according to an embodiment of the present disclosure.

The following description in combination with the Figures is provided to assist in understanding the teachings disclosed herein. The description is focused on specific implementations and embodiments of the teachings, and is provided to assist in describing the teachings. This focus should not be interpreted as a limitation on the scope or applicability of the teachings.

For aesthetic, strength, and performance reasons, information handling system chassis parts may be designed with a metal structure. In an embodiment, a laptop information handling system, for example, may include a plurality of covers for the interior components of the information handling system. In these embodiments, a form factor case may include an "A-cover" which serves as a back cover for a display housing and a "B-cover" which may serve as the bezel, if any, and a display screen of the convertible laptop information handling system in an embodiment. In a further example, the laptop information handling system case may include a "C-cover" housing a keyboard, touchpad, and any cover in which these components are set and a "D-cover" base housing for the laptop information handling system.

With the need for utility of lighter, thinner, and more streamlined devices, the use of full metal portions for the outer covers of the display and base housing (e.g. the A-cover and the D-cover) is desirable for strength as well as aesthetic reasons. At the same time, the demands for wireless operation also increase. This includes addition of many simultaneously operating radiofrequency (RF) systems, addition of more antennas, and utilization of various antenna types. In the present specification and in the appended claims, the term "radio frequency" is meant to be understood as the oscillation rate of an electromagnetic wave. A specific frequency of an electromagnetic wave may have a wavelength that is equal to the speed of light (~300,000 km/s) divided by the frequency.

With new types of networks being developed such as 5G networks, additional antennas that operate on frequencies related to those 5G networks (i.e., high frequency (HF) band, very high frequency (VHF) band, ultra-high frequency (VHF) band, L band, S band, C band, X band, Ku band, K band, Ka band, V band, W band, and millimeter wave bands). So as to communicate with the existing networks as well as the newly developed networks, additional antennas may be added to an information handling system. However, the thinner and more streamlined devices have fewer locations and area available for mounting RF transmitters on these mobile information handling systems. One location within the information handling system where these RF systems and antennas are being pushed out of are the A-cover and B-covers. This may lead to placing the RF systems and antennas in the C-cover or D-cover of the information handling systems.

Another consequence of using metal covers is the excitation of the metal surfaces of the covers described herein. This excitation of the metal surfaces leads to destructive interference in the signals sent by the antenna. Thus, a streamlined, full metal chassis capable of meeting the increasing wireless operation demands is needed.

Some information handling systems would address these competing needs by providing for cutout portions of a metal outer chassis cover filled with plastic behind which RF transmitters/receivers would be mounted. The cutouts to accommodate radio frequency (RF) transmitters/receivers are often located in aesthetically undesirable locations and require additional plastic components to cover the cutout, thus not fully meeting the streamlining needs. The plastic components may add a component to be manufactured and can be required to be seamlessly integrated into an otherwise smooth metal chassis cover to achieve a level of aesthetics. Further, the plastic portions included may be expensive to machine, and may require intricate multi-step processes for integrating the metal and plastic parts into a single chassis. This requirement could require difficult and expensive processes to manufacture with a less aesthetically desirable result. Other options include, for aperture type antenna transmitters, creation of an aperture in the metal display panel chassis or base chassis and using the metal chassis as a ground plane for excitation of the aperture.

In addition, in the case of the convertible laptop information handling system, 360-degree configurability may be a feature available to a user during use. Thus, often an antenna such as an aperture antenna system would be located at the top (e.g. A-cover) with a plastic antenna window in a metal chassis cover to radiate in 360-degree mode (such as closed mode), or at the bottom (e.g. C-cover) to radiate in 360-degree mode (such as open mode). Such a configuration could make the display panel housing (e.g. A-cover) or even the base panel housing (e.g. C-cover) thicker, to accommodate antennas and cables behind the plastic panel at the top (or bottom) of either housing. Overall, an addition of a plastic antenna window in an A-cover or C-cover may not meet the streamlining needs. A solution is needed that does not increase the thickness of the metal chassis, and does not require additional components and manufacturing steps such as those associated with installation of extra RF transparent windows to break up the metal chassis in evident locations.

Embodiments of the present disclosure may decrease the complexity and cost of creating chasses for information handling systems by forming the outer chassis (e.g. the A-cover or the D-cover) of metal and implementing a speaker grill, in a C-cover for example, that has a portion of its perimeter that has been physically and operatively disassociated from the C-cover. The use of the speaker grill as an antenna aperture allows for the co-location of an antenna aperture with a speaker of the information handling system thereby decreasing the size of the information handling system Additionally, the use of an excited speaker grill at a location by a speaker provides for additional space at the B-cover to expand the size of any video display device of the information handling system by removing an antenna or antennas from the B-cover. This increases the usability of the information handling system by allowing for the dual use of a speaker cavity as an antenna cavity. Additionally, the cavity-backed aperture created by the speaker grill may be used to direct the RF (RF) electromagnetic (EM) radiation up and away from the information handling system. In embodiments where the information handling system is to communicate with a wider network, the RF EM signals may be directed towards the horizon up through the C-cover increasing the efficiency of data transmission between the information handling system and any access point in an open configuration.

The metal chassis in embodiments described herein may include a hinge operably connecting the A-cover to the D-cover such that the keyboard, touchpad, and speaker grill enclosed within the C-cover and attached to the D-cover may be placed in a plurality of configurations with respect to the digital display enclosed within the B-cover and attached to the A-cover. The plurality of configurations may include, but may not be limited to, an open configuration in which the A-cover is oriented at a right or obtuse angle from the D-cover (similar to an open laptop computer) and a closed configuration in which the A-cover lies substantially parallel to the D-cover (similar to a closed laptop computer), or other orientations. Despite these different configurations, however, the antenna vent co-located with an audio speaker and its metallic vent provides for the streamlining of the information handling system without compromising the ability of the antenna to transmit and receive data from and to the information handling system.

Manufacture of embodiments of the present disclosure may involve fewer extraneous parts than previous chassis by forming the exterior or outer portions of the information handling system, including the bottom portion of the D-cover and the top portion of the A-cover, from metal in some embodiments. In order to allow for manufacture of fully or nearly fully metallic outer chasses including the A-cover and the D-cover, embodiments of the present disclosure form the full form factor case enclosing the information handling system such that one or more transmitting antennas may be formed within the speaker grill integrated into the C-cover of the information handling system.

The transmitting antennas of embodiments of the present disclosure may include a portion of a speaker grill formed into a cavity-backed dynamically tunable aperture by forming a slot around a portion of the speaker grill and forming a cavity below the speaker grill. The cavity-backed dynamically tunable aperture in embodiments of the present disclosure may be a highly effective improvement on wireless antennas employed in other information handling systems. In embodiments of the present disclosure, the cavity-backed dynamically tunable aperture may be cavity-backed due to the formation of a cavity behind the speaker grill that allows RF EM radiation to resonate within this cavity so as to increase the signal power of the transmitted RF EM radiation. Some or all of the speaker cavity may also be used as the antenna cavity in some embodiments. A cavity-backed dynamically tunable aperture in embodiments of the present disclosure may cause the edges of the speaker grill to act as an RF excitable structure. Such a method of placing the cavity-backed dynamically tunable aperture at the speaker grill of the form factor case may hide the integration of any RF transparent plastic windows around the speaker grill eliminates the placement of a window elsewhere within the exterior of the A-cover, B-cover, C-cover, or the D-cover, thus decreasing the complexity and cost of manufacture. In some embodiments, a plastic trim ring may be used to visually hide the slot formed around the speaker grill. The antenna may then effectively transmit communications signal perpendicularly from the surface of the C-cover.

In embodiments described herein, the speaker grill may be excited using a wireless interface adapter that includes a tuning module. The tuning module may, in the embodiments presented herein, be operatively coupled to the speaker grill to excite the speaker grill via an antenna element, and dynamically switch frequencies based on the target frequency to be emitted by the speaker grill. In order to switch between frequencies to be emitted from the excited speaker grill, the tuning module may include a tunable capacitor. The tunable capacitor may be used to alter the ratio of impedance to capacitive reactance at the speaker grill.

In embodiments described herein, the speaker grill may be flush with a surface of the C-cover, which is the surface most likely to interface with human body parts and be visible to the user. In such embodiments, the plastic trim ring may be visually innocuous to the user while preventing objects from passing through the slot formed between the excited portion of the speaker grill and the remainder of the C-cover. Still further, the plastic trim ring may be held within the slot through the use of an undercut formed by the slot and the remaining border of the speaker grill that prevents the plastic trim ring from being removed. In an embodiment, the plastic trim ring may be compression molded into the slot so as to create a mechanical fit between the compression molded trim ring and the undercut. Because the plastic trim ring is made of plastic, any RF EM waves may be passed therethrough during operation of the information handling system while still preventing foreign objects from entering the C-cover via the slot formed.

In embodiments described herein, the dimensions of the slot formed around the portion of the speaker grill may be selected based on the frequencies to be emitted by the cavity-backed dynamically tunable aperture at the speaker grill. In an embodiment, a length of the slot along a single edge of the speaker grill is 70 mm. The slot may wrap around a width of the speaker grill for 20 mm, and return along a third side for 70 mm as well to provide a slot length of 160 mm in an example embodiment. In another embodiment, the length of the slot along a single edge of the speaker grill is 40 mm along a first side. In this embodiment, the slot may wrap around a width of the speaker grill and return along the third side. Each of first and third sides may be the same length, or may be different lengths and a shunt may be used to bifurcate the slot lengths as well. These specific lengths may allow the speaker grill to emit lower and higher frequencies (i.e., the 70 mm embodiment) or higher frequencies (i.e., the 40 mm embodiment). In one example embodiment, presented herein, the width of the slot formed between the speaker grill and the C-cover may be 1.5 mm. In the embodiment, the 1.5 mm width may be sufficient to electrically isolate that portion of the speaker grill from the C-cover thereby preventing any excitation currents being formed at the C-cover and causing electric noise during RF EM transmission by the speaker grill.

Examples are set forth below with respect to particular aspects of an information handling system including case portions such as for a laptop information handling system including the chassis components designed with a fully metal structure and configurable such that the information handling system may operate in any of several usage mode configurations.

FIG. 1 shows an information handling system 100 capable of administering each of the specific embodiments of the present disclosure. The information handling system 100, in an embodiment, can represent the mobile information handling systems 210, 220, and 230 or servers or systems located anywhere within network 200 described in connection with FIG. 2 herein, including the remote data centers operating virtual machine applications. Information handling system 100 may represent a mobile information handling system associated with a user or recipient of intended wireless communication. A mobile information handling system may execute instructions via a processor such as a microcontroller unit (MCU) operating both firmware instructions or hardwired instructions for the antenna adaptation controller 134 to achieve WLAN or WWAN antenna optimization according to embodiments disclosed herein. The application programs operating on the information handling system 100 may communicate or otherwise operate via concurrent wireless links, individual wireless links, or combinations over any available radio access technology (RAT) protocols including WLAN protocols. These application programs may operate in some example embodiments as software, in whole or in part, on an information handling system while other portions of the software applications may operate on remote server systems. The antenna adaptation controller 134 of the presently disclosed embodiments may operate as firmware or hardwired circuitry or any combination on controllers or processors within the information handing system 100 for interface with components of a wireless interface adapter 120. It is understood that some aspects of the antenna adaptation controller 134 described herein may interface or operate as software or via other controllers associated with the wireless interface adapter 120 or elsewhere within information handling system 100. In an embodiment, the antenna adaptation controller 134 may control a tuning module used to excite the speaker grill as described herein. The tuning module may, in the embodiments presented herein, be operatively coupled to the speaker grill, for example via an antenna element, to excite the speaker grill and dynamically switch frequencies based on the target frequency to be emitted by the speaker grill. In order to switch between frequencies to be emitted from the excited speaker grill, the tuning module may include a tunable capacitor and one or more shunt switch paths. The tunable capacitor and shunt switch paths may be used to alter the ratio of impedance to capacitive or inductive reactance at the speaker grill.

Information handling system 100 may also represent a networked server or other system from which some software applications are administered or which wireless communications such as across WLAN or WWAN may be conducted. In other aspects, networked servers or systems may operate the antenna adaptation controller 134 for use with a wireless interface adapter 120 on those devices similar to embodiments for WLAN or WWAN antenna optimization operation according to according to various embodiments.

The information handling system 100 may include a processor 102 such as a central processing unit (CPU), a graphics processing unit (GPU), or both. Moreover, the information handling system 100 can include a main memory 104 and a static memory 106 that can communicate with each other via a bus 108. As shown, the information handling system 100 may further include a video display unit 110, such as a liquid crystal display (LCD), an organic light emitting diode (OLED), a flat panel display, or a solid-state display. Display 110 may include a touch screen display module and touch screen controller (not shown) for receiving user inputs to the information handling system 100. Touch screen display module may detect touch or proximity to a display screen by detecting capacitance changes in the display screen. Additionally, the information handling system 100 may include an input device 112, such as a keyboard, and a cursor control device, such as a mouse or touchpad or similar peripheral input device. The information handling system may include a power source such as battery 114 or an A/C power source. The information handling system 100 can also include a disk drive unit 116, and a signal generation device 118, such as a speaker or remote control. The information handling system 100 can include a network interface device such as a wireless adapter 120. The information handling system 100 can also represent a server device whose resources can be shared by multiple client devices, or it can represent an individual client device, such as a desktop personal computer, a laptop computer, a tablet computer, a wearable computing device, or a mobile smart phone.

The information handling system 100 can include sets of instructions 124 that can be executed to cause the computer system to perform any one or more desired applications. In many aspects, sets of instructions 124 may implement wireless communications via one or more antenna systems 132 available on information handling system 100. In embodiments presented herein, the sets of instructions 124 may implement wireless communications via one or more antenna systems 132 formed as part of a speaker grill formed within a C-cover of a laptop-type information handling system. Operation of WLAN and WWAN wireless communications may be enhanced or otherwise improved via WLAN or WWAN antenna operation adjustments via the methods or controller-based functions relating to the antenna adaptation controller 134 disclosed herein. For example, instructions or a controller may execute software or firmware applications or algorithms which utilize one or more wireless links for wireless communications via the wireless interface adapter as well as other aspects or components. The antenna adaptation controller 134 may execute instructions as disclosed herein for monitoring wireless link state information, information handling system configuration data, SAR proximity sensor detection, or other input data to generate channel estimation and determine antenna radiation patterns. In the embodiments presented herein, the antenna adaptation controller 134 may execute instructions as disclosed herein to transmit a communications signal from an antenna system formed as part of a speaker grill that is excited to resonant a target frequency at a slot formed around a portion of the speaker grill in order to transmit an electromagnetic wave at the target frequency or harmonics thereof. The term "antenna system" described herein is meant to be understood as any object that emits a RF (RF) electromagnetic (EM) wave therefrom. According to some embodiments described herein an "antenna system" includes a speaker grill that is excited by an excitation circuit that includes a tuning module. This excitation of the speaker grill may cause RF EM waves to be emitted at edges of portions of the speaker grill where a slot has been formed around the speaker grill to both physically and operatively uncoupled at least a portion of the speaker grill from a C-cover of the information handling system.

Additionally, the antenna adaptation controller 134 may prevent noise sourced beyond the speaker grill from creating interference with the determined frequency, or harmonics thereof. In the embodiments presented herein, the antenna adaptation controller 134 may execute instructions as disclosed herein to adjust, via a parasitic coupling element, change the directionality and/or pattern of the emitted RF signals from the antenna.

The antenna adaptation controller 134 may implement adjustments to wireless antenna systems and resources via a radio frequency integrated circuit (RFIC) front end 125 and WLAN or WWAN radio module systems within the wireless interface device 120. The antenna adaptation controller 134, in an embodiment, may implement adjustments to wireless antenna systems that operate on frequencies related to those 5G networks (i.e., high frequency (HF) band, very high frequency (VHF) band, ultra-high frequency (VHF) band, L band, S band, C band, X band, Ku band, K band, Ka band, V band, W band, and millimeter wave bands). Aspects of the antenna optimization for the antenna adaptation controller 134 may be included as part of an antenna front end 125 in some aspects or may be included with other aspects of the wireless interface device 120 such as WLAN radio module such as part of the radio frequency (RF) subsystems 130. The antenna adaptation controller 134 described in the present disclosure and operating as firmware or hardware (or in some parts software) may remedy or adjust one or more of a plurality of antenna systems 132 via selecting power adjustments and adjustments to an antenna adaptation network to modify antenna radiation patterns emitted by the speaker grill, an antenna element, and any parasitic coupling element operations in various embodiments.

Multiple WLAN or WWAN antenna systems that include the speaker grill may operate on various communication frequency bands such as under IEEE 802.11a and IEEE 802.11g (i.e., medium frequency (MF) band, high frequency (HF) band, very high frequency (VHF) band, ultra-high frequency (VHF) band, L band, S band, C band, X band, Ku band, K band, Ka band, V band, W band, and millimeter wave bands) providing multiple band options for frequency channels. In some embodiments, the antenna systems may operate as 5G networks that implement relatively higher data transfer wavelengths such as high frequency (HF) band, very high frequency (VHF) band, ultra-high frequency (VHF) band, L band, S band, C band, X band, Ku band, K band, Ka band, V band, W band, and millimeter wave bands. Further antenna radiation patterns and selection of antenna options or power levels may be adapted due physical proximity of other antenna systems, of a user with potential SAR exposure, or improvement of RF channel operation according to received signal strength indicator (RSSI), signal to noise ratio (SNR), bit error rate (BER), modulation and coding scheme index values (MCS), or data throughput indications among other factors. In some aspects WWAN or WLAN antenna adaptation controller may execute firmware algorithms or hardware to regulate operation of the one or more antenna systems 132 such as WWAN or WLAN antennas in the information handling system 100 to avoid poor wireless link performance due to poor reception, poor MCS levels of data bandwidth available, or poor indication of throughput due to indications of low RSSI, low power levels available (such as due to SAR), inefficient radiation patterns among other potential effects on wireless link channels used.

Various software modules comprising software application instructions 124 or firmware instructions may be coordinated by an operating system (OS) and via an application programming interface (API). An example operating system may include Windows®, Android®, and other OS types known in the art. Example APIs may include Win 32®, Core Java® API, Android® APIs, or wireless adapter driver API. In a further example, processor 102 may conduct processing of mobile information handling system applications by the information handling system 100 according to the systems and methods disclosed herein which may utilize wireless communications. The computer system 100 may operate as a standalone device or may be connected such as using a network, to other computer systems or peripheral devices. In other aspects, additional processor or control logic may be implemented in graphical processor units (GPUs) or controllers located with radio modules or within a wireless adapter 120 to implement method embodiments of the antenna adaptation controller and antenna optimization according to embodiments herein. Code instructions 124 in firmware, hardware or some combination may be executed to implement operations of the antenna adaptation controller and antenna optimization on control logic or processor systems within the wireless adapter 120 for example.

In a networked deployment, the information handling system 100 may operate in the capacity of a server or as a client user computer in a server-client user network environment, or as a peer computer system in a peer-to-peer (or distributed) network environment. The information handling system 100 can also be implemented as or incorporated into various devices, such as a personal computer (PC), a tablet PC, a set-top box (STB), a PDA, a mobile information handling system, a tablet computer, a laptop computer, a desktop computer, a communications device, a wireless smart phone, wearable computing devices, a control system, a camera, a scanner, a printer, a personal trusted device, a web appliance, a network router, switch or bridge, or any other machine capable of executing a set of instructions (sequential or otherwise) that specify actions to be taken by that machine. In a particular embodiment, the computer system 100 can be implemented using electronic devices that provide voice, video or data communication. Further, while a single information handling system 100 is illustrated, the term "system" shall also be taken to include any collection of systems or sub-systems that individually or jointly execute a set, or multiple sets, of instructions to perform one or more computer functions.

The disk drive unit 116 may include a computer-readable medium 122 in which one or more sets of instructions 124 such as software can be embedded. Similarly, main memory 104 and static memory 106 may also contain computer-readable medium for storage of one or more sets of instructions, parameters, or profiles 124. The disk drive unit 116 and static memory 106 also contains space for data storage. Some memory or storage may reside in the wireless adapter 120. Further, the instructions 124 that embody one or more of the methods or logic as described herein. For example, instructions relating to the WWAN or WLAN antenna adaptation system or antenna adjustments described in embodiments herein may be stored here or transmitted to local memory located with the antenna adaptation controller 134, antenna front end 125, or wireless module in RF subsystem 130 in the wireless interface adapter 120.

In a particular embodiment, the instructions, parameters, and profiles 124 may reside completely, or at least partially, within a memory, such as non-volatile static memory, during execution of antenna adaptation by the antenna adaptation controller 134 in wireless interface adapter 132 of information handling system 100. As explained, some or all of the WWAN or WLAN antenna adaptation and antenna optimization may be executed locally at the antenna adaptation controller 134, RF front end 125, or wireless module subsystem 130. Some aspects may operate remotely among those portions of the wireless interface adapter or with the main memory 104 and the processor 102 in parts including the computer-readable media in some embodiments.

Battery 114 may be operatively coupled to a power management unit that tracks and provides power stat data 126. This power state data 126 may be stored with the instructions, parameters, and profiles 124 to be used with the systems and methods disclosed herein in determining WWAN or WLAN antenna adaptation and antenna optimization in some embodiments.

The network interface device shown as wireless adapter 120 can provide connectivity to a network 128, e.g., a wide area network (WAN), a local area network (LAN), wireless local area network (WLAN), a wireless personal area network (WPAN), a wireless wide area network (WWAN), or other network. Connectivity may be via wired or wireless connection. Wireless adapter 120 may include one or more RF subsystems 130 with transmitter/receiver circuitry, modem circuitry, one or more unified antenna front end circuits 125, one or more wireless controller circuits such as antenna adaptation controller 134, amplifiers, antenna systems 132 and other radio frequency (RF) subsystem circuitry 130 for wireless communications via multiple radio access technologies. Each RF subsystem 130 may communicate with one or more wireless technology protocols. The RF subsystem 130 may contain individual subscriber identity module (SIM) profiles for each technology service provider and their available protocols for subscriber-based radio access technologies such as cellular LTE communications. The wireless adapter 120 may also include antenna systems 132 which may be tunable antenna systems or may include an antenna adaptation network for use with the system and methods disclosed herein to optimize antenna system operation. Additional antenna system adaptation network circuitry (not shown) may also be included with the wireless interface adapter 120 to implement WLAN or WWAN modification measures as described in various embodiments of the present disclosure.

In some aspects of the present disclosure, a wireless adapter 120 may operate two or more wireless links. In a further aspect, the wireless adapter 120 may operate the two or more wireless links with a single, shared communication frequency band such as with the Wi-Fi WLAN operation or 5G LTE standard WWAN operations in an example aspect. For example, a 5 GHz wireless communication frequency band may be apportioned under the 5G standards for communication on either small cell WWAN wireless link operation or Wi-Fi WLAN operation as well as other wireless activity in LTE, WiFi, WiGig, Bluetooth, or other communication protocols. In some embodiments, the shared, wireless communication bands may be transmitted through one or a plurality of antennas. Other communication frequency bands are contemplated for use with the embodiments of the present disclosure as well.

In other aspects, the information handling system 100 operating as a mobile information handling system may operate a plurality of wireless adapters 120 for concurrent radio operation in one or more wireless communication bands. The plurality of wireless adapters 120 may further operate in nearby wireless communication bands in some disclosed embodiments. Further, harmonics, environmental wireless conditions, and other effects may impact wireless link operation when a plurality of wireless links are operating as in some of the presently described embodiments. The series of potential effects on wireless link operation may cause an assessment of the wireless adapters 120 to potentially make antenna system adjustments according to the WWAN or WLAN antenna adaptation control system of the present disclosure.

The wireless adapter 120 may operate in accordance with any wireless data communication standards. To communicate with a wireless local area network, standards including IEEE 802.11 WLAN standards, IEEE 802.15 WPAN standards, WWAN such as 3GPP or 3GPP2, or similar wireless standards may be used. Wireless adapter 120 and antenna adaptation controller 134 may connect to any combination of macro-cellular wireless connections including 2G, 2.5G, 3G, 4G, 5G or the like from one or more service providers. Utilization of RF communication bands according to several example embodiments of the present disclosure may include bands used with the WLAN standards and WWAN carriers which may operate in both license and unlicensed spectrums. For example, both WLAN and WWAN may use the Unlicensed National Information Infrastructure (U-NII) band which typically operates in the ~5 MHz frequency band such as 802.11 a/h/j/n/ac (e.g., center frequencies between 5.170-5.785 GHz). It is understood that any number of available channels may be available under the 5 GHz shared communication frequency band in example embodiments. WLAN, for example, may also operate at a 2.4 GHz band. WWAN may operate in a number of bands, some of which are propriety but may include a wireless communication frequency band at approximately 2.5 GHz band for example. In additional examples, WWAN carrier licensed bands may operate at frequency bands of approximately 700 MHz, 800 MHz, 1900 MHz, or 1700/2100 MHz for example as well. In the example embodiment, mobile information handling system 100 includes both unlicensed wireless RF communication capabilities as well as licensed wireless RF communication capabilities. For example, licensed wireless RF communication capabilities may be available via a subscriber carrier wireless service. With the licensed wireless RF communication capability, WWAN RF front end may operate on a licensed WWAN wireless radio with authorization for subscriber access to a wireless service provider on a carrier licensed frequency band. With the advent of 5G networks, any number of protocols may be implemented including global system for mobile communications (GSM) protocols, general packet radio service (GPRS) protocols, enhanced data rates for GSM evolution (EDGE) protocols, code-division multiple access (CDMA) protocols, universal mobile telecommunications system (UMTS) protocols, long term evolution (LTE) protocols, long term evolution advanced (LTE-A) protocols, WiMAX, LTE, and LTE Advanced, LTE-LAA, small cell WWAN and IP multimedia core network subsystem (IMS) protocols, for example, and any other communications protocols suitable for the method(s), system(s) and device(s) described herein, including any proprietary protocols.

The wireless adapter 120 can represent an add-in card, wireless network interface module that is integrated with a main board of the information handling system or integrated with another wireless network interface capability, or any combination thereof. In an embodiment the wireless adapter 120 may include one or more RF subsystems 130 including transmitters and wireless controllers such as wireless module subsystems for connecting via a multitude of wireless links under a variety of protocols. In an example embodiment, an information handling system may have an antenna system transmitter 132 for 5G small cell WWAN, Wi-Fi WLAN or WiGig connectivity and one or more additional antenna system transmitters 132 for macro-cellular communication. The RF subsystems 130 include wireless controllers to manage authentication, connectivity, communications, power levels for transmission, buffering, error correction, baseband processing, and other functions of the wireless adapter 120.

The RF subsystems 130 of the wireless adapters may also measure various metrics relating to wireless communication pursuant to operation of an antenna system as in the present disclosure. For example, the wireless controller of a RF subsystem 130 may manage detecting and measuring received signal strength levels, bit error rates, signal to noise ratios, latencies, power delay profile, delay spread, and other metrics relating to signal quality and strength. Such detected and measured aspects of wireless links, such as WWAN or WLAN links operating on one or more antenna systems 132, may be used by the antenna adaptation controller to adapt the antenna systems 132 according to an antenna adaptation network according to various embodiments herein. In one embodiment, a wireless controller of a wireless interface adapter 120 may manage one or more RF subsystems 130. The wireless controller also manages transmission power levels which directly affect RF subsystem power consumption as well as transmission power levels from the plurality of antenna systems 132. The transmission power levels from the antenna systems 132 may be relevant to specific absorption rate (SAR) safety limitations for transmitting mobile information handling systems. To control and measure power consumption via a RF subsystem 130, the RF subsystem 130 may control and measure current and voltage power that is directed to operate one or more antenna systems 132.

The wireless network may have a wireless mesh architecture in accordance with mesh networks described by the wireless data communications standards or similar standards in some embodiments but not necessarily in all embodiments. The wireless adapter 120 may also connect to the external network via a WPAN, WLAN, WWAN or similar wireless switched Ethernet connection. The wireless data communication standards set forth protocols for communications and routing via access points, as well as protocols for a variety of other operations. Other operations may include handoff of client devices moving between nodes, self-organizing of routing operations, or self-healing architectures in case of interruption.

In some embodiments, software, firmware, dedicated hardware implementations such as application specific integrated circuits, programmable logic arrays and other hardware devices can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

In accordance with various embodiments of the present disclosure, the methods described herein may be implemented by firmware or software programs executable by a controller or a processor system. Further, in an exemplary, non-limited embodiment, implementations can include distributed processing, component/object distributed processing, and parallel processing. Alternatively, virtual computer system processing can be constructed to implement one or more of the methods or functionalities as described herein.

The present disclosure contemplates a computer-readable medium that includes instructions, parameters, and profiles 124 or receives and executes instructions, parameters, and profiles 124 responsive to a propagated signal; so that a device connected to a network 128 can communicate voice, video or data over the network 128. Further, the instructions 124 may be transmitted or received over the network 128 via the network interface device or wireless adapter 120.

Information handling system 100 includes one or more application programs 124, and Basic Input/Output System and firmware (BIOS/FW) code 124. BIOS/FW code 124 functions to initialize information handling system 100 on power up, to launch an operating system, and to manage input and output interactions between the operating system and the other elements of information handling system 100. In a particular embodiment, BIOS/FW code 124 reside in memory 104, and include machine-executable code that is executed by processor 102 to perform various functions of information handling system 100. In another embodiment (not illustrated), application programs and BIOS/FW code reside in another storage medium of information handling system 100. For example, application programs and BIOS/FW code can reside in drive 116, in a ROM (not illustrated) associated with information handling system 100, in an option-ROM (not illustrated) associated with various devices of information handling system 100, in storage system 107, in a storage system (not illustrated) associated with network channel of a wireless adapter 120, in another storage medium of information handling system 100, or a combination thereof. Application programs 124 and BIOS/FW code 124 can each be implemented as single programs, or as separate programs carrying out the various features as described herein.

While the computer-readable medium is shown to be a single medium, the term "computer-readable medium" includes a single medium or multiple media, such as a centralized or distributed database, and/or associated caches and servers that store one or more sets of instructions. The term "computer-readable medium" shall also include any medium that is capable of storing, encoding, or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories. Further, the computer-readable medium can be a random-access memory or other volatile re-writable memory. Additionally, the computer-readable medium can include a magneto-optical or optical medium, such as a disk or tapes or other storage device to store information received via carrier wave signals such as a signal communicated over a transmission medium. Furthermore, a computer readable medium can store information received from distributed network resources such as from a cloud-based environment. A digital file attachment to an e-mail or other self-contained information archive or set of archives may be considered a distribution medium that is equivalent to a tangible storage medium. Accordingly, the disclosure is considered to include any one or more of a computer-readable medium or a distribution medium and other equivalents and successor media, in which data or instructions may be stored.

Figure 2:
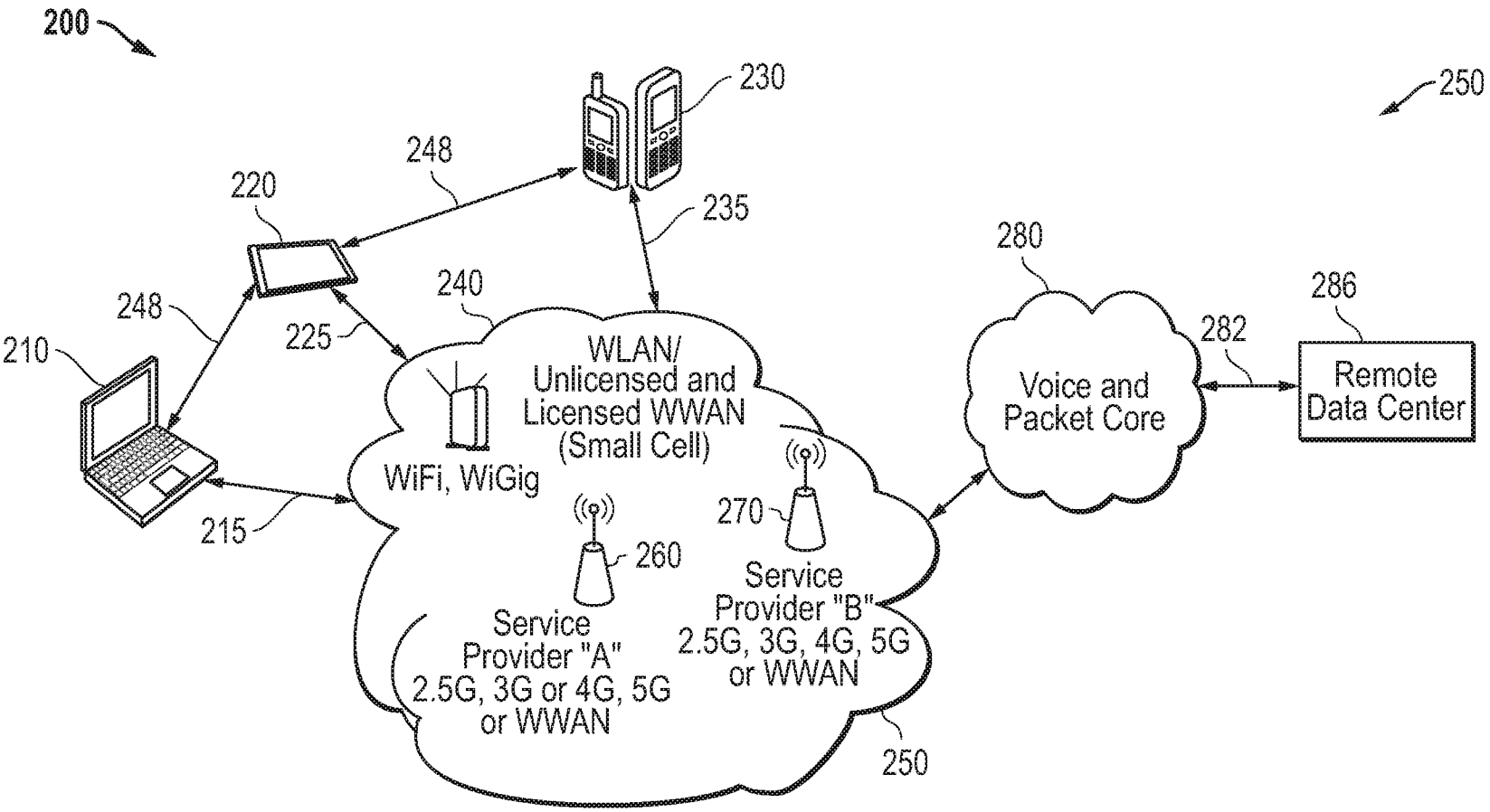
FIG. 2 is a block diagram of a network environment offering several communication protocol options and mobile information handling systems according to an embodiment of the present disclosure.

FIG. 2 illustrates a network 200 that can include one or more information handling systems 210, 220, 230. In a particular embodiment, network 200 includes networked mobile information handling systems 210, 220, and 230, wireless network access points, and multiple wireless connection link options. A variety of additional computing resources of network 200 may include client mobile information handling systems, data processing servers, network storage devices, local and wide area networks, or other resources as needed or desired. As partially depicted, systems 210, 220, and 230 may be a laptop computer, tablet computer, 360-degree convertible systems, wearable computing devices, or a smart phone device. These mobile information handling systems 210, 220, and 230, may access a wireless local network 240, or they may access a macro-cellular network 250. For example, the wireless local network 240 may be the wireless local area network (WLAN), a wireless personal area network (WPAN), or a wireless wide area network (WWAN). In an example embodiment, LTE-LAA WWAN may operate with a small-cell WWAN wireless access point option.

Since WPAN or Wi-Fi Direct Connection 248 and WWAN networks can functionally operate similar to WLANs, they may be considered as wireless local area networks (WLANs) for purposes herein. Components of a WLAN may be connected by wireline or Ethernet connections to a wider external network. For example, wireless network access points may be connected to a wireless network controller and an Ethernet switch. Wireless communications across wireless local network 240 may be via standard protocols such as IEEE 802.11 Wi-Fi, IEEE 802.11ad WiGig, IEEE 802.15 WPAN, IEEE 802.11, IEEE 1914/1904, IEEE P2413/1471/42010, or 5G small cell WWAN communications such as eNodeB, or similar wireless network protocols. Alternatively, other available wireless links within network 200 may include macro-cellular connections 250 via one or more service providers 260 and 270. Service provider macro-cellular connections may include 2G standards such as GSM, 2.5G standards such as GSM EDGE and GPRS, 3G standards such as W-CDMA/UMTS and CDMA 2000, 4G standards, or 5G standards including GSM, GPRS, EDGE, UMTS, IMS, WiMAX, LTE, and LTE Advanced, LTE-LAA, small cell WWAN, and the like.

Wireless local network 240 and macro-cellular network 250 may include a variety of licensed, unlicensed or shared communication frequency bands as well as a variety of wireless protocol technologies ranging from those operating in macrocells, small cells, picocells, or femtocells.

In some embodiments according to the present disclosure, a networked mobile information handling system 210, 220, or 230 may have a plurality of wireless network interface systems capable of transmitting simultaneously within a shared communication frequency band. That communication within a shared communication frequency band may be sourced from different protocols on parallel wireless network interface systems or from a single wireless network interface system capable of transmitting and receiving from multiple protocols. Similarly, a single antenna or plural antennas may be used on each of the wireless communication devices. Example competing protocols may be local wireless network access protocols such as Wi-Fi/WLAN, WiGig, and small cell WWAN in an unlicensed, shared communication frequency band. Example communication frequency bands may include unlicensed 5 GHz frequency bands or 3.5 GHz conditional shared communication frequency bands under FCC Part 96. Wi-Fi ISM frequency bands that may be subject to sharing include 2.4 GHz, 60 GHz, 900 MHz or similar bands as understood by those of skill in the art. Within local portion of wireless network 250 access points for Wi-Fi or WiGig as well as small cell WWAN connectivity may be available in emerging 5G technology such as high frequency (HF) band, very high frequency (VHF) band, ultra-high frequency (VHF) band, L band, S band, C band, X band, Ku band, K band, Ka band, V band, W band, and millimeter wave bands. This may create situations where a plurality of antenna systems are operating on a mobile information handling system 210, 220 or 230 via concurrent communication wireless links on both WLAN and WWAN and which may operate within the same, adjacent, or otherwise interfering communication frequency bands. The antenna may be a transmitting antenna that includes high-band, medium-band, low-band, and unlicensed band transmitting antennas. Alternatively, embodiments may include a single transceiving antennas capable of receiving and transmitting, and/or more than one transceiving antennas. Each of the antennas included in the information handling system 100 in an embodiment may be subject to the FCC regulations on specific absorption rate (SAR). The antenna in the embodiments described herein is an aperture antenna (i.e., a cavity-backed dynamic tunable aperture antenna system) intended for efficient use of space within a metal chassis of an information handling system. Aperture antennas in embodiments of the present disclosure may be an effective improvement on wireless antennas employed in previous information handling systems.

The voice and packet core network 280 may contain externally accessible computing resources and connect to a remote data center 286. The voice and packet core network 280 may contain multiple intermediate web servers or other locations with accessible data (not shown). The voice and packet core network 280 may also connect to other wireless networks similar to 240 or 250 and additional mobile information handling systems such as 210, 220, 230 or similar connected to those additional wireless networks. Connection 282 between the wireless network 240 and remote data center 286 or connection to other additional wireless networks may be via Ethernet or another similar connection to the world-wide-web, a WAN, a LAN, another WLAN, or other network structure. Such a connection 282 may be made via a WLAN access point/Ethernet switch to the external network and be a backhaul connection. The access point may be connected to one or more wireless access points in the WLAN before connecting directly to a mobile information handling system or may connect directly to one or more mobile information handling systems 210, 220, and 230. Alternatively, mobile information handling systems 210, 220, and 230 may connect to the external network via base station locations at service providers such as 260 and 270. These service provider locations may be network connected via backhaul connectivity through the voice and packet core network 280.

Remote data centers may include web servers or resources within a cloud environment that operate via the voice and packet core 280 or other wider internet connectivity. For example, remote data centers can include additional information handling systems, data processing servers, network storage devices, local and wide area networks, or other resources as needed or desired. Having such remote capabilities may permit fewer resources to be maintained at the mobile information handling systems 210, 220, and 230 allowing streamlining and efficiency within those devices. Similarly, remote data center permits fewer resources to be maintained in other parts of network 200.

Although 215, 225, and 235 are shown connecting wireless adapters of mobile information handling systems 210, 220, and 230 to wireless networks 240 or 250, a variety of wireless links are contemplated. Wireless communication may link through a wireless access point (Wi-Fi or WiGig), through unlicensed WWAN small cell base stations such as in network 240 or through a service provider tower such as that shown with service provider A 260 or service provider B 270 and in network 250. In other aspects, mobile information handling systems 210, 220, and 230 may communicate intra-device via 248 when one or more of the mobile information handling systems 210, 220, and 230 are set to act as an access point or even potentially an WWAN connection via small cell communication on licensed or unlicensed WWAN connections. For example, one of mobile information handling systems 210, 220, and 230 may serve as a Wi-Fi hotspot in an embodiment. Concurrent wireless links to information handling systems 210, 220, and 230 may be connected via any access points including other mobile information handling systems as illustrated in FIG. 2.

Figure 3A:
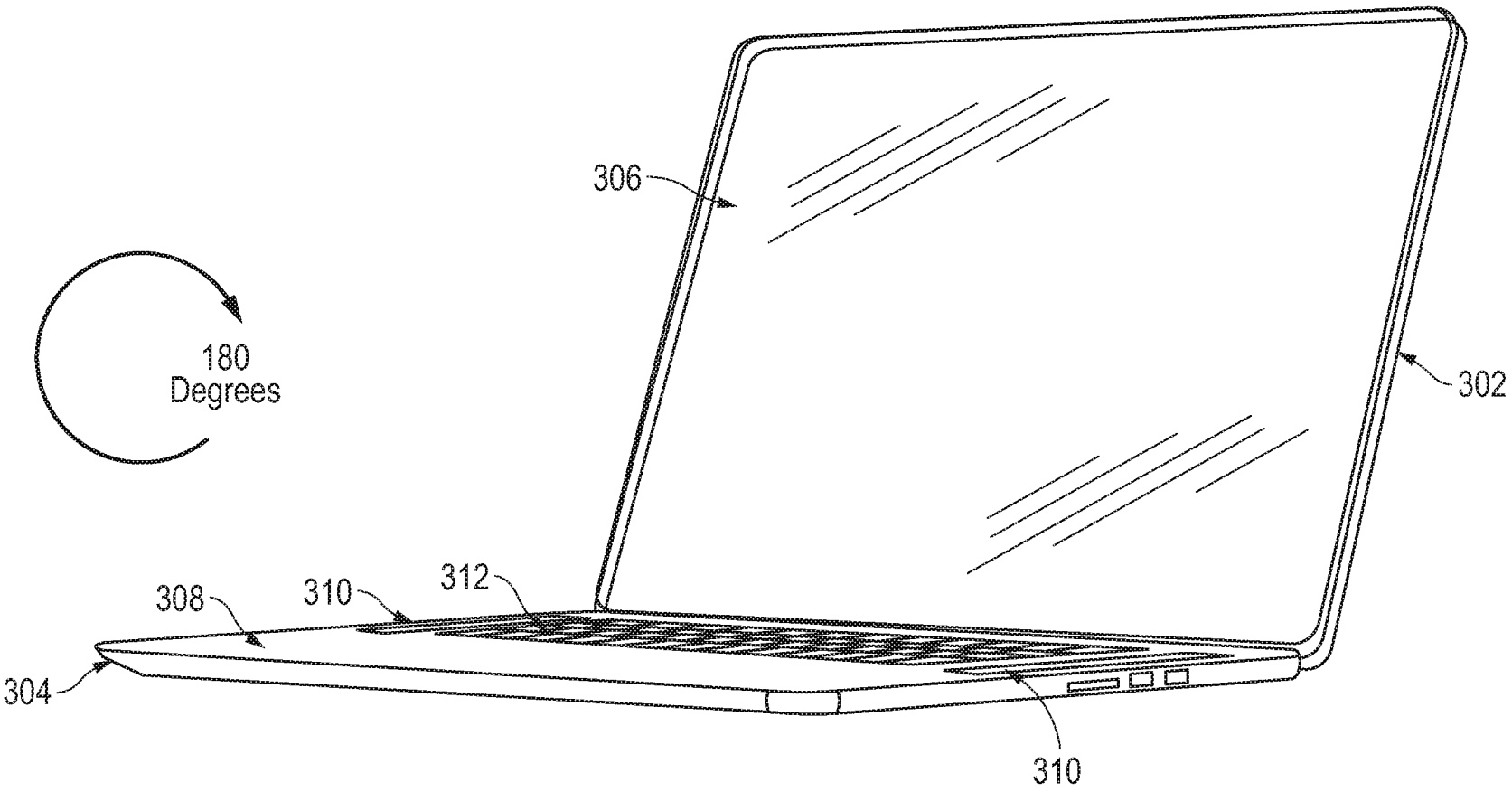
FIG. 3A is a graphical illustration of an information handling system placed in an open configuration according to an embodiment of C-cover including a speaker grill according to an embodiment of the present disclosure.

FIG. 3A is a graphical illustration of a metal chassis including a base chassis and display chassis placed in an open configuration according to an embodiment of the present disclosure. The open configuration is shown for illustration purposes. It is understood that a closed configuration would have the lid chassis fully closed onto the base chassis. The metal chassis 300 in an embodiment may comprise an outer metal case or shell of an information handling system such as a tablet device, laptop, or other mobile information handling system. As shown in FIG. 3A, the metal chassis 300, in an embodiment, may further include a plurality of chassis or cases. For example, the metal chassis 300 may further include an A-cover 302 functioning to enclose a portion of the information handling system. As another example, the metal chassis 300, in an embodiment, may further include a D-cover 304 functioning to enclose another portion of the information handling system along with a C-cover 308 which may include a transmitting/receiving antenna according to the embodiments described herein. The C-cover 308 may include, for example, a keyboard, a trackpad, or other input/output (I/O) device. When placed in the closed configuration, the A-cover 302 forms a top outer protective shell, or a portion of a lid for the information handling system, while the D-cover 304 forms a bottom outer protective shell, or a portion of a base. When in the fully closed configuration, the A-cover 302 and the D-cover 304 would be substantially parallel to one another.

In some embodiments, both the A-cover 302 and the D-cover 304 may be comprised entirely of metal. In some embodiments, the A-cover 302 and D-cover 304 may include both metallic and plastic components. For example, plastic components that are radio-frequency (RF) transparent may be used to form a portion of the C-cover 308 where a speaker grill 310 interfaces with the C-cover 308. According to the embodiments of the present disclosure, the speaker grill 310 may be formed as a part of the C-cover. In these examples, the speaker grill 310 may be formed within the C-cover 308 by forming a speaker grill 310 on a side portion of the C-cover 308 as shown in FIG. 3A. In the embodiments described herein, a portion of the speaker grill 310 may be physically separated from the C-cover 308 by forming a slot around a portion of the speaker grill 310. As is described herein, the length of the slot around the portion of the speaker grill 310 may be dependent on a target frequency to be emitted upon excitation of the speaker grill 310 by a tuning module. Additionally, in the present specification and in the appended claims, the term "portion" is meant to be understood as a part of a whole. Therefore, in the embodiments disclosed herein, the slot formed around the speaker grill 310 may be less than a total cut-out of the speaker grill 310 from the C-cover 308.

The speaker grill 310 may, therefore, be an integral part of the C-cover 308. In these examples, the speaker grill 310 may also be used to cover or protect a speaker placed below the C-cover 308 and speaker grill 310 in order to provide audio output to a user of the information handling system. The formation of the antenna system that incorporates the speaker grill 310 as the excitation object allows for the removal of the antenna system from the A-cover 302 and B-cover 306 or for the addition of antenna systems that may be required such as with implementations of various 5G technologies. Consequently, the space within the A-cover 302/B-cover 306 assembly where an antenna may have been placed may be eliminated allowing for a relatively larger video display device placed therein, for example. As a result of placing the antenna within the C-cover 308 as part of the speaker grill 310, the capabilities of information handling system may be increased while also increasing user satisfaction during use.

In an embodiment, the speaker grill 310 may be formed at any location on the C-cover 308. Therefore, although FIG. 3A shows two speaker grills 310 located to the left and right of a keyboard 112, the present specification contemplates that the speaker grill 310 or speaker grills 310 may be formed along any surface of the C-cover 308. In the embodiments, each of the individual speaker grills 310 may be excited to emit an RF EM wave signal at different frequencies allowing for the ability of the information handling system to communicate on a variety of RATs.

In an embodiment, the A-cover 302 may be movably connected to a back edge of the D-cover 304 via one or more hinges. In this configuration shown in FIG. 3A the hinges allow the A-cover 302 to rotate from and to the D-cover 304 allowing for multiple orientations of the information handling system as described herein. In an embodiment, the information handling system may include a sensor to detect the orientation of the information handling system and activate or deactivate any of a number of antenna systems associated with the speaker grill 310 based on the occurrence of any specific orientation. In some embodiments, the information handling system may be a laptop with limited rotation of the A-cover 304 with regard to the D-cover 304, for example up to 180°. In other embodiments the information handling system may be a convertible information handling system with full rotation to a tablet configuration.

Figure 3B:
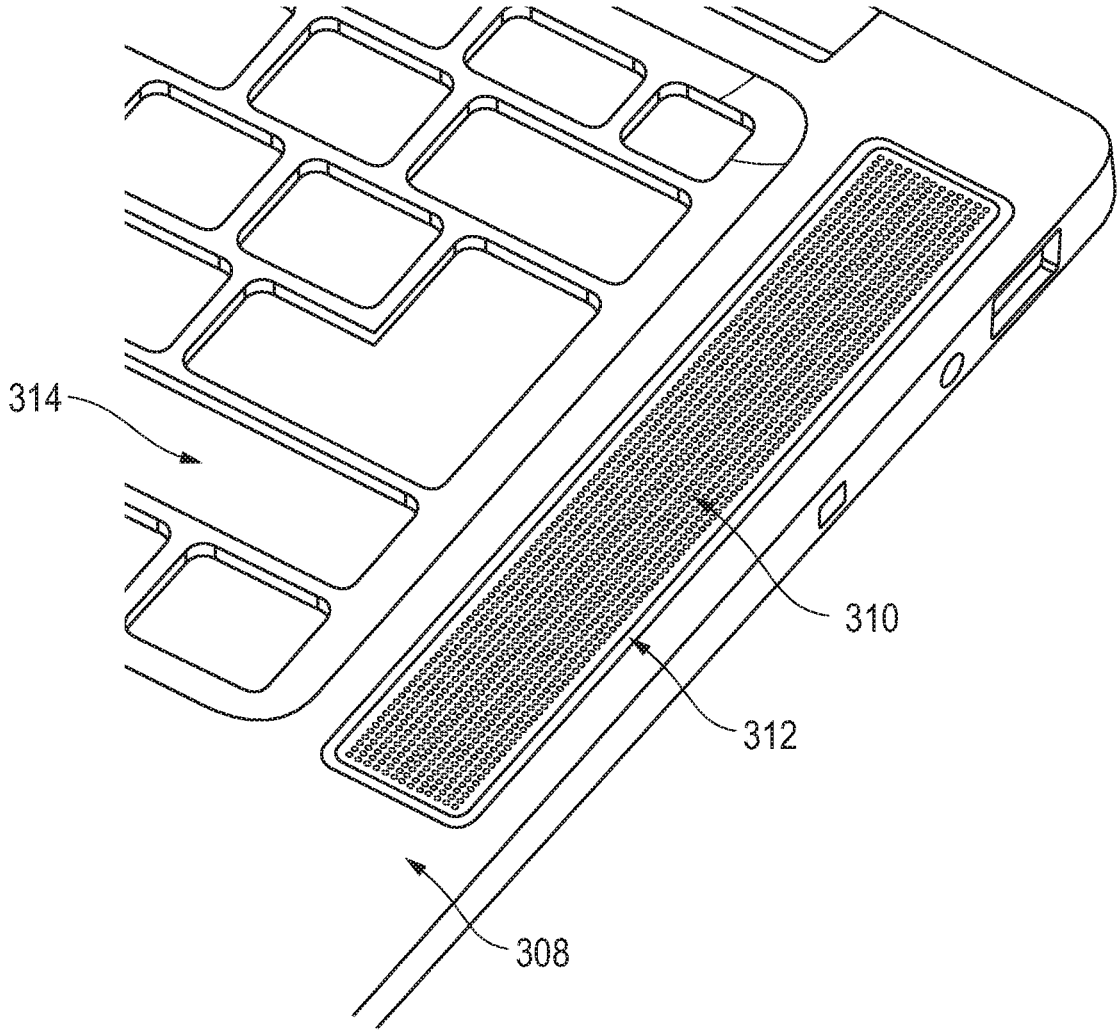
FIG. 3B is a perspective graphical illustration of a C-cover and speaker grill of an information handling system according to an embodiment of the present disclosure.

FIG. 3B is a perspective graphical illustration of a C-cover 308 and speaker grill 310 of an information handling system according to an embodiment of the present disclosure. FIG. 3B shows the C-cover 308 without a keyboard 112 as described in connection with FIG. 3A. In the embodiment shown in FIG. 3B a side portion of the base chassis is shown which may be part of the D-cover 304 as shown or part of the C-cover 308 in various embodiments. Portions of the information handling system chassis have been removed for ease of illustration. The present specification contemplates that, during assembly, the D-cover 304 and keyboard 112 along with other components of the information handling system are to be assembled together with the C-cover 308 and its speaker grill 310.

The C-cover 308 may include a number of vias 314 through which keys of a keyboard may be placed. Additionally, the C-cover 308 may include a speaker grill 310. The speaker grill 310, as described herein, may server a plurality of functions. A first function may include a physical barrier between the user and a speaker positioned below the speaker grill 310 and C-cover 308. This speaker may receive input from a processor and provide output (i.e., music and notification sounds) to a user during operation of the information handling system. As a physical carrier, the speaker grill 310 may prevent a user from touch and damaging the speaker as well as other delicate elements placed below the C-cover 308. In an embodiment, the speaker grill 310 may include a number of holes through which sound waves from the speaker may pass.

A second function of the speaker grill 310 is to propagate RF EM waves emitted from the speaker grill 310. In the embodiments described herein, the speaker grill 310 may have a slot formed around a portion of the circumference of the speaker grill 310. The slot may be cut between the speaker grill 310 and the C-cover 308 using any type of manufacturing process including laser ablation, electroforming, anisotropic etching, photolithography, or any other type of precision fabrication processing. As described herein, the slot may be formed along one edge of the speaker grill 310 or along multiple edges of the speaker grill 310. In a specific embodiment, the slot may be formed around a first edge of the speaker grill 310, wrap around to a second edge of the speaker grill 310, and continue onto terminate along a third edge of the speaker grill 310. In this specific embodiment, the slot may make a U-shaped slot around a portion of the perimeter of the speaker grill 310.

In order to prevent physical access by objects or the user below the C-cover 308, the speaker grill 310 includes a plastic trim ring 312. In an embodiment, the plastic trim ring 312 may be placed around a portion of the speaker grill 310. In an example, the plastic trim ring 312 may be placed are an entirety of the perimeter of the speaker grill 310. In either embodiment, the plastic trim ring 312 formed around the speaker grill 310 and be formed to lie flush with the speaker grill 310, the C-cover 308, or both. Placing the plastic trim ring 312 flush with the speaker grill 310, the C-cover 308, or both may render the information handling system aesthetically appealing while also preventing objects from passing through the C-cover 308 via the slot that is, in part, filled by the plastic trim ring 312. Still further, because the plastic trim ring 312 is made of a RF transparent material (i.e., plastic), RF EM wave emissions from the speaker grill 310 may still be allowed to propagate from the speaker grill 310 without being blocked by a RF non-transparent material. In any embodiment described herein, the color of the plastic trim ring 312 may be chosen to match the color of the C-cover 308 so as to hide the existence of the plastic trim ring 312 thereby increasing the aesthetics of the information handling system.

Although FIG. 3B shows a single speaker grill 310 speaker grill 310 formed into the C-cover 308, the present specification contemplates that any number of speaker grills 310 may be formed into the C-cover 308. In this embodiment, the length and width of the slot formed along the perimeter of the speaker grill 310 may be distinguished from slots associated with other speaker grills 310 so as to alter the band of RF EM waves for emission from that specific speaker grill 310. Consequently, the information handling system may include multiple speaker grills 310 capable of transmitting data at multiple RF bands consecutively or concurrently. Further, any speaker grill may have a plurality of frequencies ranges that may be transceived from it and may also include a plurality of perimeter slots of various sizes in some embodiments to accommodate a plurality of radio frequency bands. These features increase the communication abilities of the information handling system such that, in some embodiments, the information handling system can communicate via LTE, WiFi, WiGig, Bluetooth, or other communication protocols based on the frequency band emitted by the individual speaker grills 310. Thus, according to the embodiments presented herein, the antenna systems being incorporated into the speaker grill 310 allows for flexibility in the type of antenna being formed at the speaker grill 310 thereby increasing the ability for a user to, during purchase, determine how the information handling system is to communicate with a wireless infrastructure by selecting RF EM frequency band is going to be used for these communications. Additionally, placement of each of the speaker grills 310 or the speaker grill 310 shown in FIG. 3B may be anywhere on the surface of the C-cover 308 with the slot or slots cut out around a portion of the perimeter of the speaker grill 310 on the C-cover 308. Also, by incorporating the antenna system described herein in to the speaker grill 310 allows for more compact and streamlined thereby adding to the aesthetics of the information handling system.

In an embodiment presented herein, the plastic trim ring 312 may be maintained within the slot or slots formed around the speaker grill 310 via an undercut. The undercut may be formed so as to prevent the plastic trim ring 312 from being removed vertically from the slot formed. As described herein, because the slot is not formed completely around the speaker grill 310, a portion of the perimeter of the speaker grill 310 may have a trench formed around the perimeter that does not cut entirely through the C-cover 308 as the slot does. In this embodiment, the trench may also include an undercut that prevents the plastic trim ring 312 form being removed vertically (i.e., perpendicular to the surface of the C-cover 308) from the C-cover 308 thereby exposing the trench and slot as described herein.

In an embodiment presented herein, the speaker grill 310 may include a cavity formed on a back side of the speaker grill 310. This cavity may be formed with any number of walls formed around a perimeter of a back side of the speaker grill 310. This cavity allows for the excitation RF EM waves created by the excitation of the speaker grill 310 to resonate therein. This resonation of the RF EM waves allows for the amplification of the RF EM waves that propagate from the peninsula of the speaker grill 310 formed by the slot. In an embodiment, the size and shape of the cavity formed may be tailored to resonate a target frequency, or harmonics thereof, to be emitted by the speaker grill 310 as described herein.

Figure 3C:
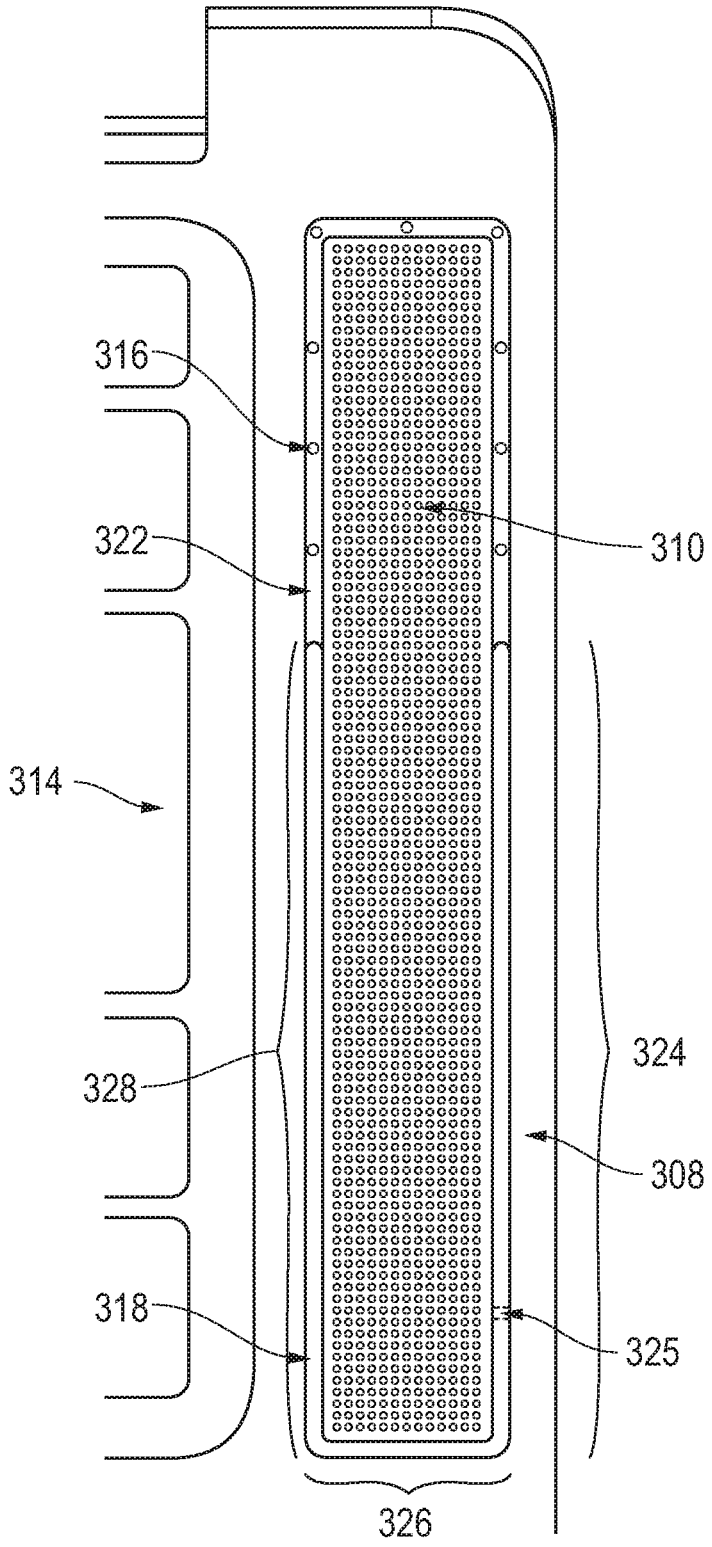
FIG. 3C is another graphical illustration of the C-cover and speaker grill of an information handling system according to an embodiment of the present disclosure.

FIG. 3C is another graphical illustration of the C-cover 308 and speaker grill 310 of an information handling system shown in FIG. 3B according to an embodiment of the present disclosure. In an embodiment, the C-cover 308 may include a number of vias 314 through which keys of a keyboard may be placed during manufacturing and construction of the information handling system.

As shown in FIG. 3C, the speaker grill 310 has the plastic trim ring 312 removed from the slot 318 and trench 322. A distinguishing characteristic between the slot 318 and the trench 322 is that the slot 318 has been cut entirely through the C-cover 308. As described herein, the length of the slot 318 around the speaker grill 310 may be selected based on the frequency bands to be emitted by the speaker grill 310 when the speaker grill 310 is excited by the tuning module described herein. All remaining portions of the perimeter of the speaker grill 310 may have a trench 322 formed around the speaker grill 310.

As described herein, the trench 322 and slot 318 may have an undercut formed therein that prevents the plastic trim ring 312 from being removed after co-molding in the C-cover 308. This undercut may, in an embodiment, be formed along an edge of the C-cover 308 where the slot 318 and trench 322 are formed so that a portion of the plastic trim ring 312 may be locked into the trench 322 and slot 318 when placed or formed therein. In an embodiment, the plastic trim ring 312 may be formed into the slot 318 and trench 322 using nano-molding technology (NMT). In this embodiment, the metal of the C-cover 308 may be directly bonded to the plastic trim ring 312 by creating the slot 318 and trench 322 as well as the undercut by, for example, acid etching those structures. The NMT may, once the slot 318, trench 322, and undercut are acid-etched, continue with molding the plastic trim ring 312 into the slot 318 and trench 322 using compression molding, transfer molding, injection molding, or other types of plastic molding processes.

In an embodiment, the trench 322 may include at least one interlocking hole 316. The interlocking hole 316 may be used to secure the trim ring 312 within the trench 322 when the trim ring 312 is coupled to the slot 318 and trench 322. Similar to the undercut formed in the trench 322 and slot 318, the interlocking hole 316 may secure the trim ring 312 within the trench 322 and, in this case, prevent the trim ring 312 from moving laterally within the trench 322 and slot 318. The interlocking hole 316 may, therefore, tightly secure the trim ring 312 within the trench 322 increasing the stability of the plastic trim ring 312 around the speaker grill 310 and maintaining the aesthetic characteristics of the speaker grill 310 of the information handling system.

Similar to FIG. 3B, the C-cover 308 is depicted in FIG. 3C as including a plurality of vias 314. The vias 314 may each receive a key from a keyboard. Thus, although FIG. 3C does not show a keyboard operatively coupled to the C-cover 308, the present specification contemplates that, during assembly, a keyboard may be operatively coupled to the C-cover 308. As described herein, the slot 318 may have a first length 324 along a first edge of the speaker grill 310, a second length 326 along a second edge of the speaker grill 310, and a third length 328 along a third edge of the speaker grill 310. In this embodiment, the slot 318 has been formed around a lower portion of the speaker grill 310. In an embodiment the first length 324 may be 70 mm, the second length 326 may be 20 mm, and the third length 328 may be 70 mm so that the slot 318 may be tuned at 160 mm to match a specific RF wavelength such at 900 MHz associated with, for example, a cellular communication protocol as described herein. In any embodiment presented herein, the overall length of the slot 318 formed along a portion of the perimeter of the speaker grill 310 may be created based on the RF EM waves to be emitted by the speaker grill 310 and the present specification contemplates a variety lengths of the slot 318 in order to tune the antenna of the speaker grill emit those RF EM waves. The slot 318 length in the perimeter of the speaker grill does not include the trench 322 in embodiments herein. Either or both sides of the slot around a portion of the speaker grill may be changed to tune the antenna to a frequency to be emitted. In an embodiment where the length of the slot is 70 mm around the perimeter of the speaker grill 310, regardless of any dielectric loading of the speaker grill 310, the RF EM waves emitted by the excitation of the speaker grill 310 may be 2 GHz in a spectrum mapping with certain RF LTE bands such as band 1, band 2, band 4, band 66, band 25, band 34, and band 39. In an embodiment where the length of the slot is 160 mm around the perimeter of the speaker grill 310, regardless of any dielectric loading of the speaker grill 310, the speaker grill 310 may resonate at 900 MHz with a spectrum mapping with certain RF LTE bands such as band 5, band 8, and band 26. In an embodiment where the length of the slot is 30 mm around the perimeter of the speaker grill 310, regardless of any dielectric loading of the speaker grill 310, the speaker grill 310 may resonate at 5 GHz with a spectrum mapping with certain RF LTE bands such as band 48, and a portion of a 5G new radio (5GNR) sub 6 GHz band of n79.

Figure 3D:
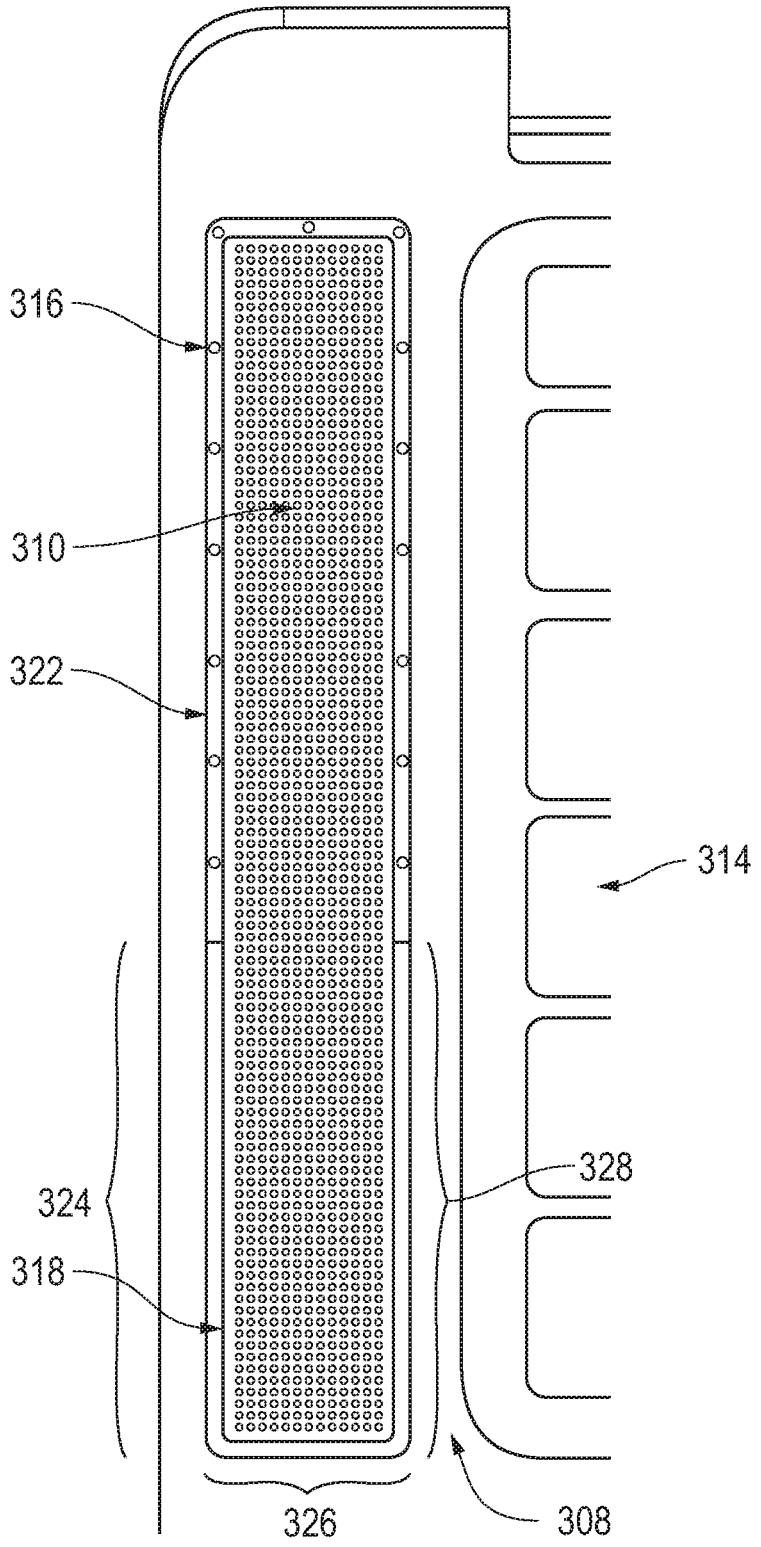
FIG. 3D is a graphical illustration of another speaker grill formed into a C-cover of an information handling system according to an embodiment of the present disclosure.

Additionally, although FIG. 3C shows a speaker grill 310 formed on a right side of the C-cover 308, the present specification contemplates that the speaker grill 310 or an additional speaker grill 310 may be formed on other edges or surfaces of the C-cover 308 such as shown in FIG. 3D. FIG. 3D is a graphical illustration of another speaker grill 310 formed into a C-cover of an information handling system according to an embodiment of the present disclosure. The speaker grill 310 shown in the FIG. 3D may be similar to some aspects of the speaker grill 310 shown in FIG. 3C. In an embodiment, the C-cover 308 may include a number of vias 314 through which keys of a keyboard may be placed.

In the speaker grill 310 shown in FIG. 3D, a slot 318 may be formed around a partial perimeter of the speaker grill 310. The slot 318 may terminate at a trench 322 formed around a remaining portion of the perimeter of the speaker grill 310. During assembly, a trim ring (not shown) may be formed into the slot 318 and trench 322 via compression molding, transfer molding, injection molding, or other types of plastic molding processes. The placement of the trim ring into the trench 322 and slot 318 prevents objects from passing through the slot 318 and into the C-cover 308 and D-cover 304 assembly. Additionally, the trim ring may be formed to be level with a surface of the C-cover 308. The trim ring may, therefor, appear to a user to be an accentuating feature of the information handling system while hiding the slot 318 and trench 322 of speaker grill 310 for emissions of RF EM waves.

The trench 322 and slot 318 may also include an undercut formed in one or both of the sides of the trench 322 and slot 318. The undercut may prevent the vertical movement out of the trim ring so that the trim ring remains in the slot 318 and trench 322. By securing the trim ring via use of the undercut, the trim ring may not be removed by the user thereby preventing damage to the components of the information handling system if objects were to be passed through the slot 318. FIG. 3D also shows at least one interlocking hole 316 that also prevents the trim ring from moving horizontally within the trench 322. Again, this prevents the removal of the plastic trim ring by the user from the trench 322. During assembly, the plastic of the plastic trim ring may be compressed into the interlocking hole 316 and undercut so that there is a locking fit between the trim ring and the speaker grill 310 and C-cover 308.

FIG. 3D shows a slot 318 that is relatively shorter than that slot shown in FIG. 3C. In an embodiment, the slot 318 may have a first length 324, second length 326, and third length 328. Thus, the slot 318 may be formed around three edges of the speaker grill 310 creating a peninsula of metal of the speaker grill 310. In an embodiment, the length of the first length 324 is 40 mm. The length of the first length 324 may be chosen to tune the speaker grill 310 to emit a certain RF EM wave such as those used in cellular networks or other computer networks as described herein. In an embodiment the first length 324 may be 40 mm so that the slot 318 may be tuned to match a specific RF wavelength associated with, for example, a cellular communication protocol as described herein. In an embodiment where the length of the slot is 40 mm around the perimeter of the speaker grill 310, regardless of any dielectric loading of the speaker grill 310, the RF EM waves emitted by the excitation of the speaker grill 310 may be 3.5 GHz in a spectrum mapping with certain RF LTE bands such as band 42, band 43, band 48, and 5G new radio (5GNR) sub 6 GHz bands of n77 and n78. In an embodiment where the length of the slot is 70 mm around the perimeter of the speaker grill 310, regardless of any dielectric loading of the speaker grill 310, the RF EM waves emitted by the excitation of the speaker grill 310 may be 2 GHz in a spectrum mapping with certain RF LTE bands such as band 1, band 2, band 4, band 66, band 25, band 34, and band 39. In an embodiment where the length of the slot is 60 mm around the perimeter of the speaker grill 310, regardless of any dielectric loading of the speaker grill 310, the RF EM waves emitted by the excitation of the speaker grill 310 may be 2.5 GHz in a spectrum mapping with certain RF bands such as band 7, band 41, and band 38. In an embodiment where the length of the slot is 160 mm around the perimeter of the speaker grill 310, regardless of any dielectric loading of the speaker grill 310, the speaker grill 310 may resonate at 900 MHz with a spectrum mapping with certain RF LTE bands such as band 5, band 8, and band 26. In an embodiment where the length of the slot is 30 mm around the perimeter of the speaker grill 310, regardless of any dielectric loading of the speaker grill 310, the speaker grill 310 may resonate at 5 GHz with a spectrum mapping with certain RF LTE bands such as band 48, a portion of a 5G new radio (5GNR) sub 6 GHz band of n79.

In any embodiment described herein including those shown in FIGS. 3C and 3D, the width of the slot 318 may be 1.5 mm. Again, along with the length of the slot 318, the width (i.e., 1.5 mm) of the slot 318 may be selected so that a specific RF EM wave may be emitted by the speaker grill 310. Still further, the width of the slot 318 may be selected to not only physically separate a portion of the speaker grill 310 from the C-cover 308 but also operatively separate the portion of the speaker grill 310 from the C-cover 308 with regard to surface currents and providing for a transmission edge along the slot 318. The portion of the speaker grill 310 may be operatively separated from the C-cover 308 such that the RF EM wave emissions from the sides of the speaker grill 310 may propagate without interference from the metal of the C-cover 308. Consequently, in any embodiment presented herein, the width of the slot 318 may be at least wide enough to allow such propagation.

In some embodiments presented herein, the slot may include a spoke 325 as an optional embodiment to select the length of slot 318 for tuning to a frequency and bifurcate the slot length. Although spoke 325 is shown as an optional embodiment in FIG. 3C, the spoke 325 may be utilized across slot 318 at any location to tune the slot length and may be utilized with embodiments shown in several embodiments herein. In some embodiments, a slot length around a portion of the perimeter of the speaker grill may be selected to tune the antenna for a selected frequency band to be transceived or a slot bifurcated by spoke 325 may be used to tune the antenna. The spoke 325 or shunt may be a portion of the C-cover 308 that physically couples the C-cover 308 to the speaker grill 310 at a location by forming a bridge across the slot 318. Therefore, in these embodiments, the slot 318 may be bifurcated into two sections. The spoke 325 may be part of the C-cover that bridges the slot 318 and has not been machined entirely through the C-cover for example. In other embodiments, a conductive shunt may be placed across the slot 318 from the speaker grill to the rest of the C-cover to form a spoke 325 such as with a wire or metal grounding strip. The present specification contemplates that the spoke 325 can be placed at any distance along the length of the slot 318 so as to accommodate for a specific resonant frequency or frequencies and harmonics thereof that is to be produced by the resonating speaker grill 310. During operation, in this embodiment, a first section of the slot 318 may serve as an aperture that emits a first resonate frequency of RF EM waves while a second section of the slot 318, either concurrently or selectively, serves as an aperture that emits a second resonate frequency of RF EM waves. The placement of the spoke 325 may, in some embodiments, dictate the resonate frequencies emitted at the edges of the slot 318. In an embodiment where a section of the bifurcated slot formed by the shunt 325 is 60 mm around the perimeter of the speaker grill 310 for example, regardless of any dielectric loading of the speaker grill 310, the speaker grill 310 may resonate at 2.5 GHz.

As described herein, the speaker grill 310 may also have a cavity (not shown) formed on a backside of the speaker grill 310. The cavity may be formed with any number of walls formed around a perimeter of a back side of the speaker grill 310 that is placed next to the slot 318 along the third length 328 of the slot. This cavity allows for the excitation RF EM waves created by the excitation of the speaker grill 310 to resonate therein. This resonation of the RF EM waves allows for the amplification of the RF EM waves that propagate from the peninsula of the speaker grill 310 formed by the slot 318. In an embodiment, the size and shape of the cavity formed may be tailored to resonate a target frequency, or harmonics thereof, to be emitted by the speaker grill 310 as described herein. A portion of the D-cover 304 sidewall is also shown. Although portions of the C-cover 308 and D-cover 304 are shown in the figures of the present description, the present description contemplates that the sidewalls of the information handling system, where present, may be an integral, constituent part of either the C-cover 308 or D-cover.

Figure 3E:
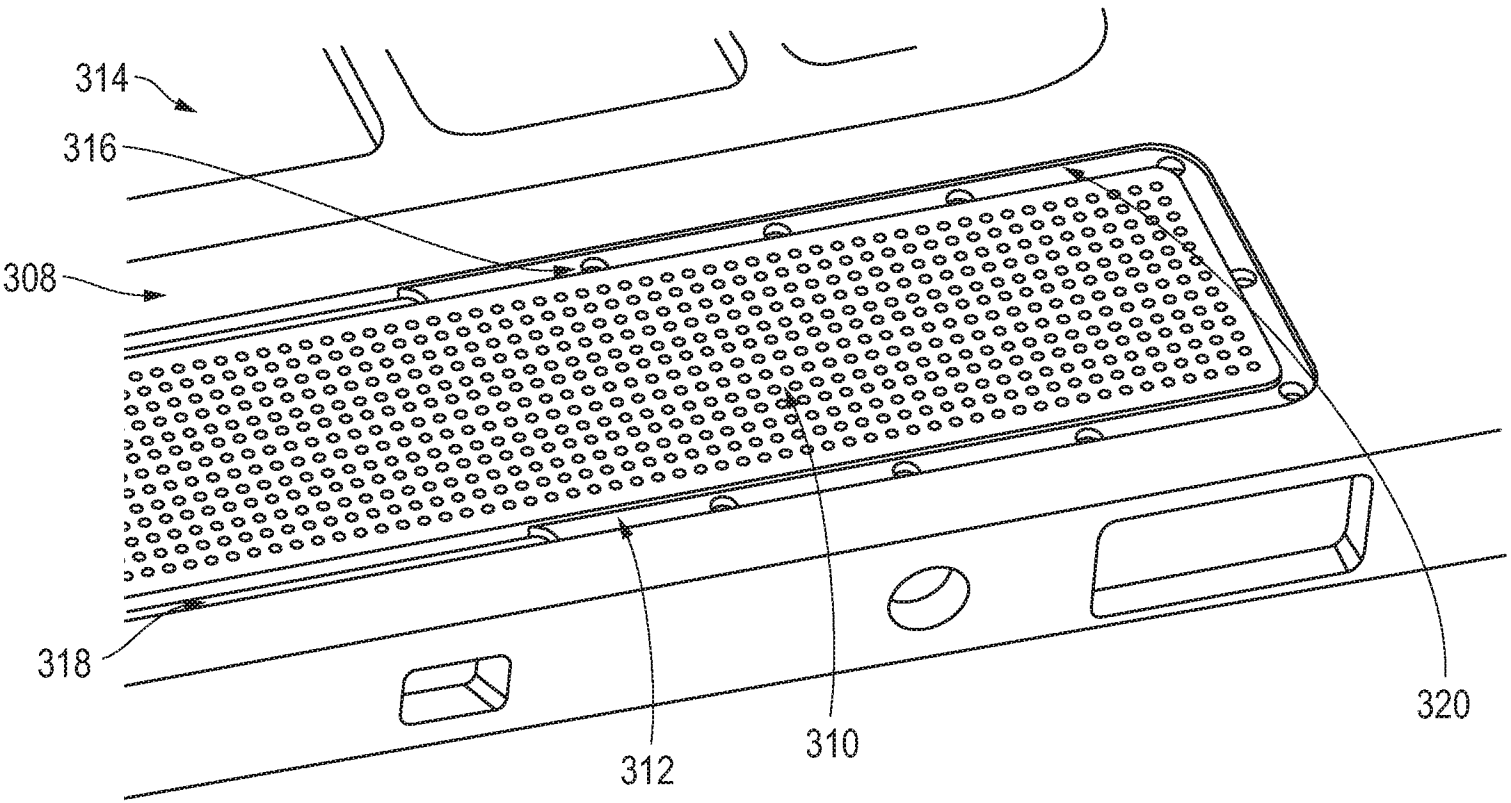
FIG. 3E is a perspective graphical illustration of a speaker grill formed into a C-cover of an information handling system according to another embodiment of the present disclosure.

FIG. 3E is a perspective graphical illustration of a speaker grill 310 formed into a C-cover 308 of an information handling system according to another embodiment of the present disclosure. In an embodiment, the C-cover 308 may include a number of vias 314 through which keys of a keyboard may be placed. During manufacturing or construction of the information handling system, keys of a keyboard may be passed through the vias 314.

FIG. 3E shows the details of the undercut 320 formed into the trench 322. Although FIG. 3E does not show the undercut formed into the slot 318, the present specification contemplates that the undercut 320 is also formed into the slot 318 so as to also retain the trim ring 312 within that portion of the perimeter of the speaker grill 310.

Also shown in FIG. 3E are the interlocking holes 316 of which, in this example, there are nine. Although FIG. 3E shows nine interlocking holes 316 being formed within the trench 322, the present specification contemplates that there may be more or less than nine interlocking holes 316 and FIG. 3E is merely an example. The interlocking holes 316 may be filled with the plastic used to form the plastic trim ring (not shown) during an NMT process as described herein. During this process the plastic used to form a trim ring may be pressed into the interlocking holes 316 as well as the undercut 320 and allowed to solidify in trench 322 and filling slot 318. After solidification of the plastic, the trim ring is prevented from moving within or out of the slot 318 and trench 322: the undercut 320 preventing vertical movement of the trim ring away from the surface of the C-cover 308 and the interlocking holes 316 preventing movement of the trim ring horizontally. Thus, during use, a user is prevented from removing the trim ring thereby potentially compromising the electrical and mechanical devices placed within the C-cover 308 and D-cover 304 assembly.

The speaker grill 310 may have a number of holes defined therein. These holes may allow sound waves from a speaker to pass through. In an embodiment, the speaker may be placed below the speaker grill 310. In a specific embodiment, the speaker may be placed at a location under speaker grill 310 where the antenna cavity is not formed. In this embodiment, the speaker is placed below the speaker grill 310 in a location where the speaker grill 310 is coupled to the C-cover 308 at trench 322 and not where the slot 318 has been formed around the speaker grill 310.

Figure 4A:
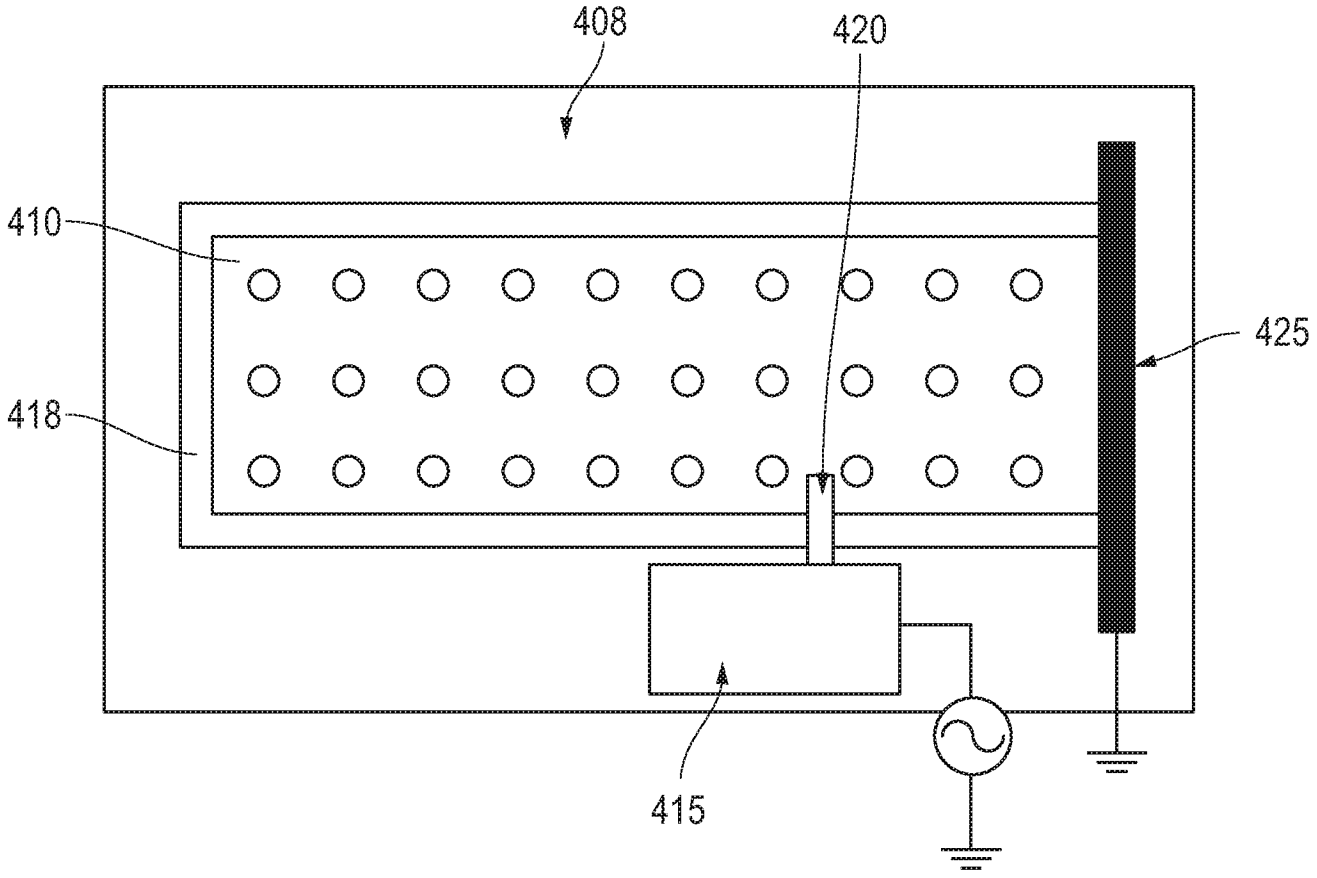
FIG. 4A is a block diagram of a speaker grill and tuning module according to an embodiment of the present disclosure.

FIG. 4A is a block diagram of a speaker grill 410 and tuning module 415 according to an embodiment of the present disclosure. FIG. 4A shows a portion of the C-cover 408 surrounding a physically and operationally separated portion of speaker grill 410. As described herein, a slot 418 may be formed around the peninsula of the speaker grill 410 as shown in FIG. 4A. FIG. 4A is a view of the speaker grill 410 from below the C-cover 408.

In order to excite the speaker grill 410, the speaker grill 410 may be operatively associated with a tuning module 415 and an antenna feed 420. The tuning module 415, among other functions, may cause an excitation current to pass to the speaker grill 410 via the antenna feed 420. This excitation current may be set based on a target RF EM wave to be emitted from the speaker grill 410. In a specific embodiment, the tuning module 415 may include a variable capacitor and RF switch in the tunable impedance matching circuits operating as a shunt type of coupled resonator. By using the variable capacitor and putting inductors in the shunt, the impedance of the antenna can be tuned to capacitive/inductive reactance at the speaker grill 410. In this embodiment, a variable capacitor may be used to alter the ratio of impedance to capacitive reactance at the speaker grill 410. In other embodiments, a tuning network, or group of tunable impedance matching circuits may be used to alter the ratio of impedance to capacitive reactance. In yet other embodiments, the tuning module 415 may include a plurality of tunable impedance matching circuits operating as a shunt type of coupled resonator decoupling network (S-CRDN). Upon tuning, the tuned RF EM waves may be transmitted from a front-end module (See, FIG. 1, 125) to the speaker grill 410 via antenna feed 420 for transmission. In an embodiment, the tuning module 415 feeds the RF EM signal to the speaker grill 410 via the antenna feed 420 located off-center to the speaker grill 410. By operatively and directly exciting the antenna feed 420 off-center from the speaker grill 410, the antenna system described herein may excite the speaker grill 410 to support a plurality of 5G FR1 frequencies. These 5G FR1 frequencies include sub-6 GHz frequency bands, some of which are bands used by previous standards, but may also be extended to cover potential new spectrum offerings from 410 MHz to 7125 MHz In an embodiment, a front-end module associated the tuning module 415 may be tied to a 5G modem. In this embodiment, the tuning module 415 may tune the slot 418 of the speaker grill 410 to dynamically switch frequencies based on the band the 5G modem operates in connection with any given network. As shown in FIGS. 3C and 3D, the tuning module 415 may be operated to allow the tuning module 415 to tune the slot 418 of the speaker grill 410 to specific spans of frequency bands based on the length of the slot 418 formed around the speaker grill 410. In an embodiment such as shown in FIGS. 3C and 3D with a right and left speaker grill 410 formed on the C-cover 408, multiple sets of frequency bands may be emitted by the information handling system based, partially, on the number of speaker grills 410, slots 418 in one or more speaker grills 410, the placement of a spoke elements used to adjust antenna resonance properties, and tuning modules 415 formed into the C-cover 408. In addition to the ability of the tuning module 415 to tune the speaker grill 410 as described herein, the communication abilities of the information handling system are significantly increased. Consequently, the ability of a user to communicate with a myriad of networks during use of information handling system is increased resulting in increased user satisfaction. Additionally, because the tuning module 415 and antenna feed 420 are hidden behind the speaker grill 410 and because the slot 418 is hidden by the plastic trim ring, the user is made unaware of the location of the antenna systems described herein increasing the desirability of the aesthetics of the information handling system described herein. Additionally, because the antenna system is incorporated into the speaker grill 410 as described herein, an antenna may be removed from the A-cover or B-cover assembly allowing the size of a display within the B-cover to be increased or for additional antennas to be deployed also resulting in user satisfaction.

In an embodiment, the speaker grill 410 may include a grounded wall 425. The grounded wall 425 may serve as part of the circuit loop formed at the edges of the speaker grill 410. In an embodiment, the grounded wall 425 serves as a conductive path taken by the excitation current from the antenna feed 420 to the source load. This grounded wall 425 may prevent the excitation current from passing beyond a point on the speaker grill 410 such as that occupied by a speaker for example. The grounding of the excitation currents by the grounded wall 425 may avoid interference by any noise source from outside the grounded wall 425 in some embodiments.

Figure 4B:
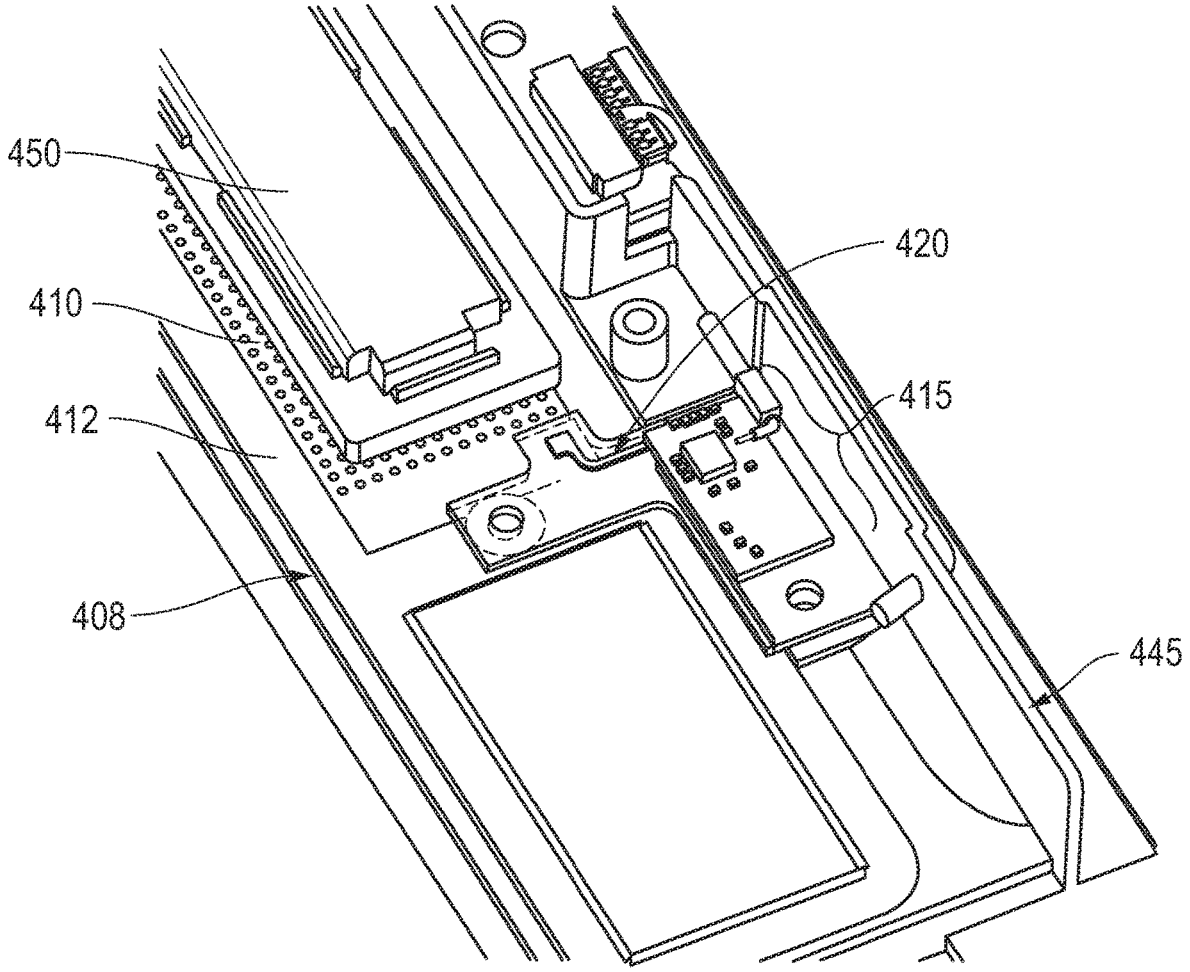
FIG. 4B is a perspective view of a speaker grill and tuning module according to another embodiment of the present disclosure.

FIG. 4B is a perspective view of a speaker grill 410 and tuning module 415 according to another embodiment of the present disclosure. FIG. 4B shows that the plastic trim ring 412 has been molded into the slot and trench formed around the speaker grill 410 as described herein. The speaker grill 410 may also be operatively coupled to a speaker 450. As seen in FIG. 4B and according to an embodiment, the speaker 450 occupies a position behind the speaker grill 410 in a location away from most of a peninsula portion defined by the slot 418 as shown, for example, in FIGS. 3C and 3D. The speaker 450 may be communicatively coupled to, for example, a processor that sends signals to the speaker 450 to cause the speaker 450 to emit audio waves therefrom. The audio waves are allowed to pass through the holes defined in the speaker grill 410 and provide, as output, sounds to the user during use of the information handling system.

Co-located with the speaker 450, in an embodiment, is the antenna system made of a portion of the speaker grill 410, the antenna feed 420 and the tuning module 415. The tuning module 415 may be operatively coupled to the speaker grill 410 via the antenna feed 420. The tuning module 415 and antenna feed 420 may excite the speaker grill 410 via a connection point between the antenna feed 420 and the speaker grill 410. The tuning module 415 may dynamically switch frequencies emitted by the excitation of the speaker grill 410 based on the target frequency to be emitted by the speaker grill 410. In an embodiment, a processor may direct the tuning module 415 to cause an excitation current to pass to the speaker grill 410 via the antenna feed 420. This excitation current may be set based on a target RF EM wave to be emitted from the speaker grill 410. In a specific embodiment, the tuning module 415 may include a variable capacitor. In this embodiment, a variable capacitor or a bank of capacitors used for tuning may be used to alter the ratio of impedance to capacitive reactance at the speaker grill 410. In other embodiments, a tuning network, or group of tunable impedance matching circuits may be used to alter the ratio of impedance to capacitive/inductive reactance. In yet other embodiments, the tuning module 415 may include a plurality of tunable impedance matching circuits operating as an S-CRDN. Upon tuning, the tuned RF EM waves may be transmitted from a front-end module (See, FIG. 1, 125) to the speaker grill 410 via antenna feed 420 for transmission. In an embodiment, the tuning module 415 feeds the RF EM signal to the speaker grill 410 via the antenna feed 420 located off-center to the speaker grill 410. By operatively coupling the antenna feed 420 off-center from the speaker grill 410, the antenna system described herein may excite the speaker grill 410 to support a plurality of 5G FR1 frequencies. These 5G FR1 frequencies include sub-6 GHz frequency bands, some of which are bands used by previous standards, but may also be extended to cover potential new spectrum offerings from 410 MHz to 7125 MHz.

Further, the tuning module 415 may be located close to the antenna portion of the speaker grill 410 creating a short connection via antenna feed 420. This inhibits noise, interference, and power loss at the antenna portion of the speaker grill 410. Tuning module 415 may be located in a space formed by the speaker cavity and may be shielded from base chassis electronics by shielding wall 445 in some embodiments.

For example, in an embodiment, the speaker grill 410 may also include a number of cavity walls, such as shielding wall 445 and sidewalls of the D-cover (not shown) that form a cavity behind the speaker grill 410 as shown in FIG. 4B. In an embodiment, the cavity is formed using a shielding wall 445 formed at the C-cover, sidewalls of the C-cover, and a back wall of the D-cover. As such, the antenna system described herein may act as a cavity-backed dynamic tunable aperture due to a resonant cavity formed behind the speaker grill 410 and the slot formed around the operative portion of the speaker grill 410 as described herein. In an embodiment, the cavity may be formed by any type of process including forming the cavity from the metal of the C-cover 408 and D-cover assembly.

During operation of the antenna system, a processor may send a signal for the tuning module 415 to excite the speaker grill 410 via the antenna feed 420 at a target frequency to which the speaker grill 410 has been formed to emit. The target frequency may be any frequency that the speaker grill 410 is capable of emitting based on the length and width of the slot 418 formed around the operative antenna portion of the speaker grill 410. In an embodiment of the present disclosure, the speaker grill 410 and tuning module 415 may be capable of emitting a target frequency or target band of frequencies and harmonics thereof. Examples include 5 GHz, 4.2 GHz, and 2.5 GHz bands among others. In an embodiment, the processor and tuning module 415 may be operatively coupled to a 5G modem to increase the communication capabilities of the antenna system to send and receive communications over a 5G network operating in frequency range 1 (FR1) from 600 MHz to 6 GHz. For example, 600 MHz to 1 GHz may operate for low bands, 1.4 GHz to 6 GHz for middle bands, high bands, and ultra-high bands. In other example embodiments, it is understood that 5G networks may operate at frequency range 2 (FR2) at up to from 26 GHz to 39 GHz or higher millimeter wave frequency bands.

Figure 4C:
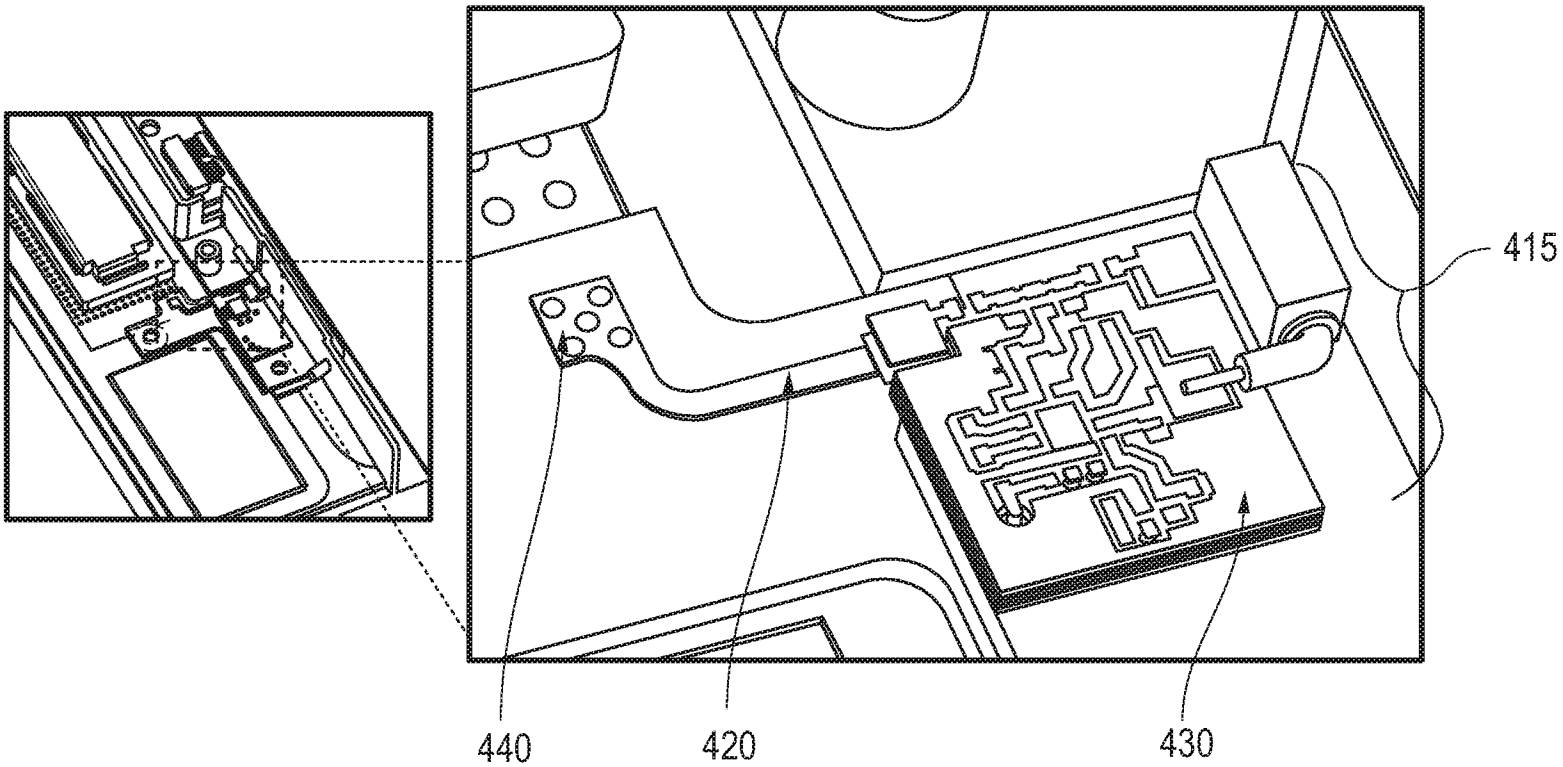
FIG. 4C is a perspective and enlarged view of the speaker grill and tuning module shown in FIG. 4B according to an embodiment of the present disclosure.

FIG. 4C is a perspective and enlarged view of the speaker grill 410 and tuning module 415 shown in FIG. 4B according to an embodiment of the present disclosure. In the enlarged image, further details of the tuning module 415 and antenna feed 420 may be seen. In an embodiment, the antenna feed 420 may have a connection point 440 to which the antenna feed 420 is operatively coupled, such as excited directly, to the speaker grill 410.

Interposed between the tuning module 415 and the antenna feed 420 is additional circuitry. This additional circuitry of the tuning module 415 shown may include, for example, an antenna adaptation controller, an antenna front end, and radio frequency subsystems, among other circuitry. In an embodiment, the additional circuitry may be formed on a printed circuit board (PCB) 430 and placed next to the speaker grill 410 with an inter-board PCB formed under the PCB 430 extending across to the aperture antenna portion of the speaker grill 410. An antenna feed 420 may, in an embodiment, be printed on the inter-board PCB formed under the PCB 430 and made to extended to a pressure connection point 440 for contact with the speaker grill 410. By placing the tuning module 415 and the antenna feed 420 close to the speaker grill 410, the length of any electrical connection is reduced thereby reducing the number of parasitic elements within an active antenna region and also reducing noise created by the introduction of longer wires or antenna feeds.

Figure 5:
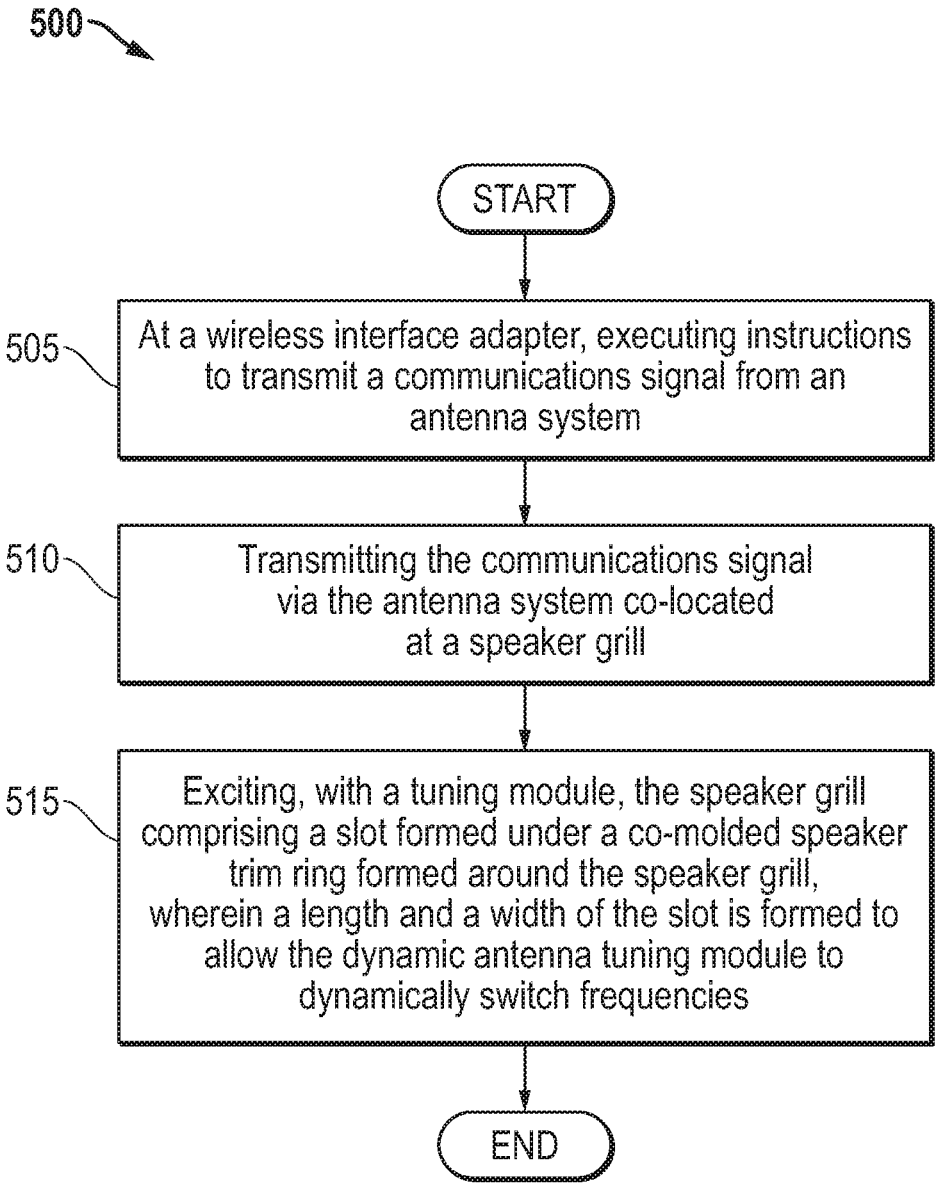
FIG. 5 is a flow diagram illustrating a method for operating an information handling system having a tuning module exciting a speaker grill formed into a C-cover of an information handling system according to an embodiment of the present disclosure.

FIG. 5 is a flow diagram illustrating a method 500 for operating an information handling system having a tuning module exciting a speaker grill formed into a C-cover of an information handling system according to an embodiment of the present disclosure. The method 500 may include, at a wireless interface adapter, executing instruction to transmit a communications signal from an antenna system at block 505. In an embodiment, the signal may originate from a processor directing the antenna system to emit a target radio frequency.

In the embodiments presented herein, the antenna system includes a speaker grill operatively coupled to a tuning module via an antenna feed. As described herein, the tuning module maybe operatively coupled to the speaker grill via the antenna feed to excite the speaker grill upon transmission, at block 510, of a communications signal via the antenna system that is co-located with the speaker grill. In an embodiment, the tuning module may dynamically switch frequencies based on the target frequency to be emitted by the speaker grill. In order to switch between frequencies to be emitted from the excited speaker grill, the tuning module may include a tunable capacitor. The tunable capacitor may be used to alter the ratio of impedance to capacitive reactance at the speaker grill.

During the transmission of the communications signal at block 510, the tuning module may excite the speaker grill at block 515. The speaker may be excited to emit a target RF EM wave therefrom along edges of the slot formed around an operative antenna portion of the speaker grill. In order to emit the RF EM signal, surface currents on the speaker grill may transmit at the slot formed around the portion of the perimeter of the speaker grill. The length of the slot may be set so that the speaker grill emits a target frequency or set of target frequency bands for example at tuned harmonics as described herein. In an embodiment, the speaker grill may operate on various communication frequency bands such as under IEEE 802.11a and IEEE 802.11g (i.e., medium frequency (MF) band, high frequency (HF) band, very high frequency (VHF) band, ultra-high frequency (VHF) band, L band, S band, C band, X band, Ku band, K band, Ka band, V band, W band, and millimeter wave bands) providing multiple band options for frequency channels.

The system may also receive RF EM transmissions via the aperture antenna portion of the speaker grill formed via the surrounding slot sized for target RF EM frequency bands. In an embodiment, a tuning module may also receive, amplify, or demodulate a received signal as understood by those of skill. At this point the processes described in method 500 may end.

Figure 6:
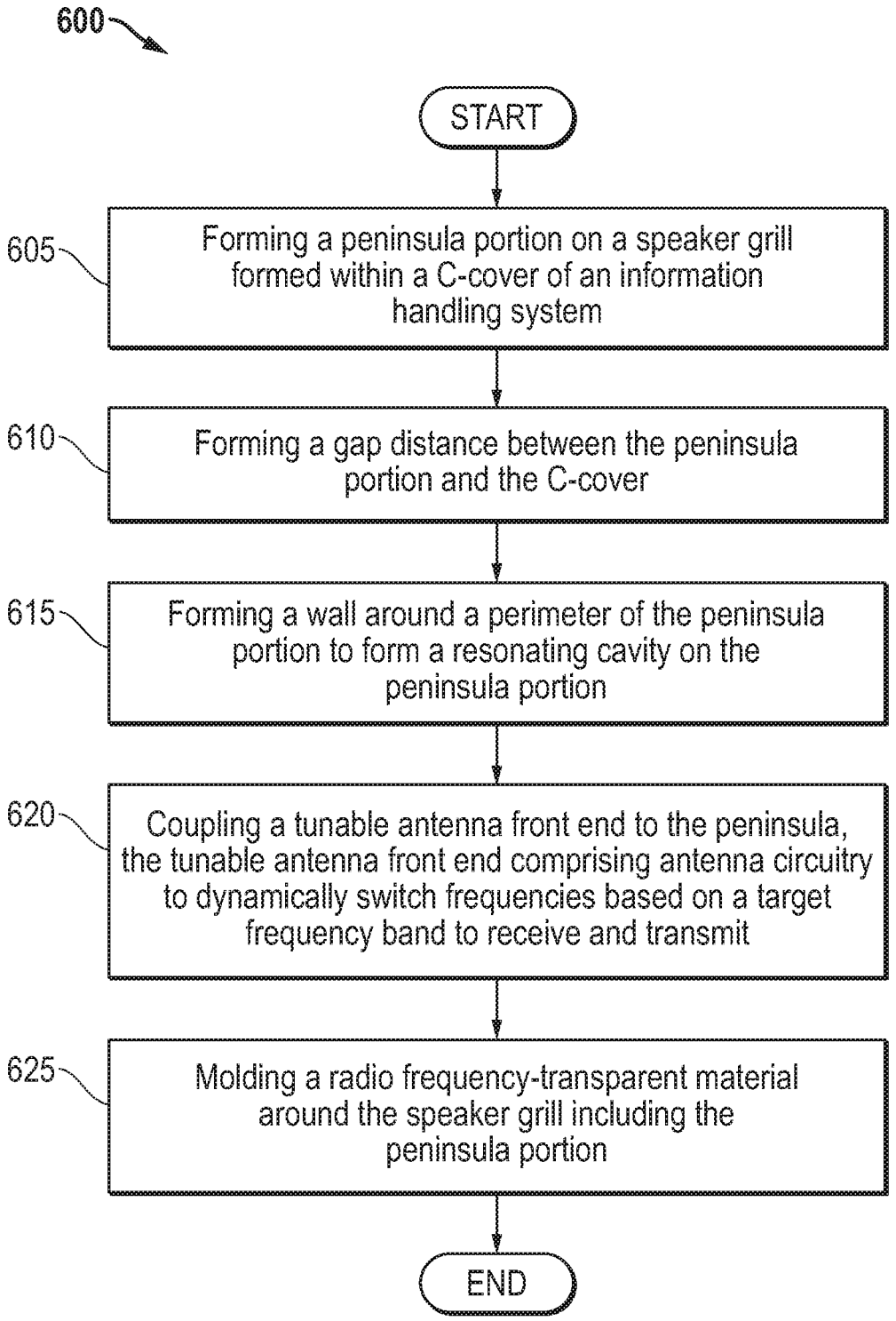
FIG. 6 is a flow diagram illustrating a method of assembling an information handling system according to an embodiment of the present disclosure.

FIG. 6 is a flow diagram illustrating a method 600 of assembling an information handling system according to an embodiment of the present disclosure. The method 600 may include, at block 605, forming a peninsula portion on a speaker grill formed within a C-cover of an information handling system. As described herein the peninsula is formed by cutting or otherwise removing a portion of the C-cover along a portion of the perimeter of the speaker grill. This removal of the portion of the C-cover forms a slot between the portion of the speaker grill and the C-cover. According to an embodiment, a specific gap distance is created around the peninsula portion and in C-cover at block 610. This gap distance or slot width, in an embodiment, may be 1.5 mm. In other embodiments, the gap distance or slot width may be more or less than 1.5 mm as appropriate in order to modify the transmitted signal or increase the ability to receive a signal at the slot. In an embodiment, the length of the slot formed along a portion of the perimeter of the speaker grill may be such that a target frequency is emitted from the speaker grill during excitation of the speaker grill by a tuning module. In an embodiment, the length of the slot may be 40 mm. In another embodiment, the length of the slot may be 70 mm. In any embodiment presented herein, the length of the slot may be related proportionality to a target RF EM signal, or harmonics thereof, to be sent or received at the slot of the speaker grill.

The method 600 may further include, at block 615, forming a wall around a perimeter of the peninsula portion to form a resonating cavity on the peninsula portion. As described herein, the cavity is formed on a back surface of the speaker grill. In any embodiment herein, the cavity may be formed by portions of the C-cover or D-cover or a combination thereof. As described herein, some of the walls that define the cavity may include sidewalls of the C-cover or D-cover. The resonant cavity created at the back of speaker grill may be used to resonate and direct the RF (RF) electromagnetic (EM) radiation up and away from the information handling system. In embodiments where the information handling system is to communicate with a wider network, the RF EM signals may be directed towards the horizon increasing the efficiency of data transmission between the information handling system and any access point.

The method 600, at block 620, may continue with coupling a tunable antenna front end to the peninsula via an antenna feed. The tunable front end may include an antenna circuitry to dynamically switch frequencies based on a target frequency band to receive and transmit. In a specific embodiment, the tunable front end may include a variable capacitor that dynamically switches frequencies based on the target frequency band used to receive and transmit data.

At 625, the method 600 may also include molding a radio frequency-transparent material around the speaker grill including the peninsula portion. In an embodiment, the radio frequency-transparent material is a plastic. The molding process in the present embodiments include compression molding, transfer molding, injection molding, or other types of plastic molding processes. The molding process may include the injection of a plastic into the slot and trench in order to form the plastic molding trim upon solidification of the plastic. In some embodiments, the plastic trim ring may be seamlessly integrated into an otherwise smooth metal chassis cover to achieve a level of aesthetics. In an embodiment, the color of plastic used to form the plastic trim ring may be selected to match or coordinate with the color of the C-cover. In an embodiment, the plastic trim ring may be painted to match or coordinate with the color of the C-cover.

The method 600 may continue at block 630 with coupling speaker components within the resonating cavity. The speaker components may include any devices used to receive audio signals from, for example, a processor, and convert those audio signals into audio waves emitted by the speaker for output to a user. These components of the speaker may include a transducer, a diaphragm, among other electronics used to operate the speaker.

The method may also include, at block 635, assembling any remaining components of the information handling system and coupling the tunable antenna front end to a motherboard of the information handling system. The other components of the information handling system include the motherboard including a processor, a main memory device, a static memory device, a video display housed within an A-cover and, where applicable, a B-cover, a battery, any input devices such as a keyboard and trackpad, and a drive unit, among other devices and components of an information handling system. In an embodiment, the components of the information handling system may include any of the components described in connection with FIG. 1.

The blocks of flow diagram of FIGS. 5 and 6 discussed above need not be performed in any given or specified order. It is contemplated that additional blocks, steps, or functions may be added, some blocks, steps or functions may not be performed, blocks, steps, or functions may occur contemporaneously, and blocks, steps or functions from one flow diagram may be performed within another flow diagram.

Although only a few exemplary embodiments have been described in detail herein, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims. In the claims, means-plus-function clauses are intended to cover the structures described herein as performing the recited function and not only structural equivalents, but also equivalent structures.

The above-disclosed subject matter is to be considered illustrative, and not restrictive, and the appended claims are intended to cover any and all such modifications, enhancements, and other embodiments that fall within the scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. An information handling system to wirelessly transmit and receive data comprising:
- a processor;
- a memory;
- an input/output (I/O) device;
- a wireless adapter;
- a metal C-cover to house a speaker grill, the speaker grill covering a speaker to emit audio waves;
- the speaker grill formed within the metal C-cover to emit a target radio frequency (RF), including:
  - a slot formed around an operative antenna portion of the speaker grill forming a peninsula of the speaker grill in the metal C-cover;
  - an antenna cavity formed on a back side of the peninsula, the antenna cavity including walls formed around the antenna cavity in the back side of the peninsula; and
- a tuning module operatively coupled to the speaker grill to excite the speaker grill and dynamically switch frequencies based on the target RF to be emitted by the speaker grill.

2. The information handling system of claim 1, wherein a width of the slot formed in the metal C-cover is selected to isolate portions of the peninsula as a RF transmitting device.

3. The information handling system of claim 1, wherein a length of the slot formed in the metal C-cover around the operative antenna portion of the speaker grill is selected based on a lowest operating frequency to be emitted by the speaker grill.

4. The information handling system of claim 1, wherein a length of the slot in the metal C-cover of the speaker grill is 160 mm.

5. The information handling system of claim 1, wherein a width of the slot is 1.5 mm.

6. The information handling system of claim 1, wherein the antenna cavity is defined by a shielding wall formed at the C-cover, a sidewall of a D-cover, a back wall of the D-cover.

7. The information handling system of claim 1, further comprising:

a plastic trim ring wherein a perimeter of the speaker grill includes a trench and the slot with an undercut portion to receive the plastic trim ring.

8. The information handling system of claim 1, wherein the tuning module includes a tunable capacitor integrated circuit to alter a port termination of the speaker grill, a tuning of the speaker grill, a phase shift of the speaker grill, or any combination thereof.

9. A C-cover and D-cover assembly for an information handling system chassis comprising:

a speaker grill made of metal in the C-cover of a base chassis portion of the information handling system chassis, the speaker grill covering a speaker;

a slot formed through the C-cover and around a portion of the speaker grill and physically and operatively separating the portion of the speaker grill from the C-cover as an antenna;

a cavity formed on a back side of the separated portion of the speaker grill, the cavity including walls formed around and along a perimeter of the separated portion of the speaker grill by metal of the D-cover base wall, D-cover sidewalls, and a shielding wall insolating a remainder of the base chassis; and a tuning integrated circuit operatively coupled to the speaker grill to excite the speaker grill and dynamically switch frequencies based on a target frequency to be emitted by the speaker grill.

10. The assembly of claim 9, further comprising an antenna feed across the slot tied to the perimeter of the speaker grill forming a current path to the tuning integrated circuit.

11. The assembly of claim 9, wherein the length and width of the slot formed around the portion of the speaker grill is selected based on a lowest operating frequency to be emitted by the speaker grill.

12. The assembly of claim 9, wherein a length of the slot along a single edge of the speaker grill is 40 mm and wherein a width of the slot is 1.5 mm.

13. The assembly of claim 9, further comprising:

a printed circuit board (PCB) including the tunable integrated circuit;

an antenna feed; and a connection point to operatively couple the tunable integrated circuit to the speaker grill.

14. The assembly of claim 9, further comprising a trim ring made of RF transparent material to fill the slot.

15. The assembly of claim 14, wherein an entire perimeter of the speaker grill includes a trench and the slot with an undercut portion to receive the trim ring.

16. The assembly of claim 9, wherein the tuning integrated circuit includes a tunable capacitor to alter a port termination of the speaker grill, a tuning of the speaker grill, a phase shift of the speaker grill, or any combination thereof.

17. An information handling system to transmit a communication signal comprising:

a processor;

a memory;

an input/output (I/O) device;

a wireless interface adapter including a tuning integrated circuit;

a speaker grill formed into a C-cover of the information handling system and operatively coupled to the tuning integrated circuit to receive excitation currents at the speaker grill, the speaker grill including:

a slot formed through the C-cover and around a portion of the speaker grill forming a peninsula on the speaker grill that operates as an antenna tuned to a target RF band based on the length of the slot; and a cavity formed on a back side of the peninsula, the cavity including walls formed around and along a perimeter of the back side of the peninsula.

18. The information handling system of claim 16, wherein the length and width of the slot formed around the portion of the speaker grill is selected based on a lowest operating wavelength to be emitted by the speaker grill.

19. The information handling system of claim 16, further comprising:

an undercut formed within the slot; and a plastic trim ring compression molded into the undercut and slot.

20. The information handling system of claim 16, wherein the tuning integrated circuit includes a tunable capacitor to alter a port termination of the speaker grill, a tuning of the speaker grill, a phase shift of the speaker grill, or any combination thereof.

* * * * *